US006232945B1

(12) United States Patent
Moriyama et al.

(10) Patent No.: US 6,232,945 B1
(45) **Date of Patent: *May 15, 2001**

(54) DISPLAY DEVICE AND ITS DRIVING METHOD

(75) Inventors: Naomi Moriyama; Youichi Masuda, both of Yokohama (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/891,109

(22) Filed: Jul. 10, 1997

(30) Foreign Application Priority Data

Jul. 11, 1996 (JP) ..... 8-182318
May 13, 1997 (JP) ..... 9-122254

(51) Int. Cl.[7] ..... G09G 3/36
(52) U.S. Cl. ..... 345/98; 345/92; 345/100
(58) Field of Search ..... 345/98–103, 94, 345/132, 63; 349/167, 92

(56) References Cited

U.S. PATENT DOCUMENTS 4,990,902 * 2/1991 Zenda ..... 345/132
5,526,015 * 6/1996 Tsuboyama et al. ..... 345/97
5,592,194 * 1/1997 Nishikawa ..... 345/127
5,801,672 * 9/1998 Masuda et al. ..... 345/98
5,899,548 * 4/1999 Ishiguro ..... 345/97

FOREIGN PATENT DOCUMENTS 7 020816 1/1995 (JP) .
7 295521 11/1995 (JP) .
7 2995521 11/1995 (JP) .

* cited by examiner

*Primary Examiner*—Steven Saras
*Assistant Examiner*—Alecia D. Nelson
(74) *Attorney, Agent, or Firm*—Oblon, Spivak, McClelland, Maier & Neustadt, P.C.

(57) ABSTRACT

The display device includes a display panel section and a video signal line driving circuit (281). The display panel section (281) includes a plurality of pixel electrodes arranged in a matrix pattern; a plurality of switching elements each arranged in correspondence to each pixel electrode; a plurality of scanning lines each connected in common to the switching elements corresponding to the pixel electrodes arranged in a same row direction, for transmitting a control signal for opening and closing the common-connected switching elements simultaneously; a plurality of video signal lines for transmitting video signals to the pixel electrodes arranged in a same column direction via the corresponding switching elements, respectively; and an opposing electrode arranged so as to be opposed to the pixel electrodes. On the other hand, the video signal line driving circuit generates a first timing signal according to a reset signal received before video data are received; selects non-display data transmitted in synchronism with the reset signal on the basis of the first timing signal; transmits the selected non-display data to the video signal line corresponding to the first timing signal; after that, selects the transmitted video data on the basis of a second timing signal; and transmits the selected video data to the video signal line corresponding to the second timing signal.

20 Claims, 23 Drawing Sheets

DISPLAY DEVICE AND ITS DRIVING METHOD

BACKGROUND OF THE INVENTION

1. Field of the Invention

The present invention relates to a display device and its driving method.

2. Description of the Prior Art

Recently, liquid crystal display devices have been noticed as flat panel devices of light weight and low power consumption. In particular, an active matrix liquid crystal display device provided with a thin film transistor (referred to as TFT, hereinafter) at each display pixel has been widely used as various displays such as TV and OA (office automation), because high definition display pictures can be obtained without any cross-talk. In addition, recently, there exists such a trial that the liquid crystal display device is used as a projector type display device according to a demand of still larger-sized display pictures.

When the active matrix display device as described above is used as a projector of smaller size, lower cost, and lower power consumption, it is essential to reduce the size of its optical system. Further, it is also necessary to reduce the size of the liquid crystal display device itself as small as about 3 inches, for instance.

Therefore, in the above-mentioned display device, there exists a trial of forming both a display pixel section and a driving circuit section for driving respective display pixels on the same substrate integral with each other.

On the other hand, it has become important to allow the display device to correspond to a plurality of image or video standards, for instance such that a picture having an aspect ratio of 4:3 based upon computer image signals is displayed on a display device composed of pixels having an aspect ratio of 16:9. In this case, it is considered that the number of the horizontal pixels including the horizontal blanking period of video signals is smaller than the number of the display pixels for constructing one horizontal pixel line on a display panel. In the case as described above, non-display data are displayed at the display pixels where corresponding video signals do not exist. In this case, as the method adopted on the driving circuit side, although it may be considered to bury the non-display data previously during the horizontal scanning period of the video signals, by changing the driving frequency of the video signals by use of a frame memory, the cost of this method is relatively high.

As another method, it may be considered to prepare both the display data and the non-display data and to select the display data or the non-display data for each pixel on the display device side in conformity with the video standard. The method of driving the display device as described above is disclosed SID 93 DIGEST p.383 to p.386 "A 1.9-in, 1.5-M pixel Driver Fully-Integrated Poly-Si TFT LCD for HDTV Projection", for instance, in which a driving circuit mainly composed of shift registers for transferring video signals in sequence is used. In this method, however, it is difficult to switch the signal lines driven in the display panel in conformity with the video signal standard.

SUMMARY OF THE INVENTION

With these problems in mind, therefore, it is the object of the present invention to provide a display device and its driving method, which can display the non-display data in the non-display areas easily.

To achieve the above-mentioned object, the first aspect of the display device according to the present invention provides a display device, comprising: a display panel section including: a plurality of pixel electrodes arranged in a matrix pattern; a plurality of switching elements each arranged in correspondence to each pixel electrode; a plurality of scanning lines each connected in common to said switching elements corresponding to said pixel electrodes arranged in a same row direction, for transmitting a control signal for opening and closing said common-connected switching elements simultaneously; a plurality of video signal lines for transmitting video signals to said pixel electrodes arranged in a same column direction via said corresponding switching elements, respectively; and a plurality of opposing electrodes each arranged so as to be opposed to each of said pixel electrodes; and a video signal line driving circuit for generating a first timing signal according to a reset signal received before video data are received; for selecting non-display data transmitted in synchronism with the reset signal on the basis of the first timing signal; for transmitting the selected non-display data to said video signal line corresponding to the first timing signal; after that, for selecting the transmitted video data on the basis of a second timing signal; and for transmitting the selected video data to said video signal line corresponding to the second timing signal.

Here, it is preferable that said video signal line driving circuit comprises: a plurality of logic circuits, each for outputting the first or second timing signal on the basis of n-bit address signals and the reset signal; and a plurality of selecting circuits, each for selecting the video data or the non-display data on the basis of an output of said logic circuit.

Further, it is preferable that said video signal line driving circuit comprises: a plurality of logic circuits, each for outputting the first or second timing signal on the basis of n-bit address signals; a plurality of first selecting circuits, each for selecting the non-display data on the basis of the first timing signal; and a plurality of second selecting circuits, each for selecting the video data on the basis of the second timing signal.

Further, it is preferable that said video signal line driving circuit comprises: a logic circuit including: a shift register circuit composed of a plurality of cascade-connected flip-flops and responsive to a start pulse, for transferring the start pulse to the succeeding-stage flip-flop in sequence in synchronism with a clock signal; and a reset circuit for outputting the first timing signals and the second timing signals on the basis of an output of each-stage flip-flop of said shift register circuit and the reset signal; and a selecting circuit for selecting the video data or the non-display data on the basis of the first timing signals and the second timing signals.

Further, it is preferable that the display device further comprises switching means connected between a predetermined-stage flip-flop and the succeeding-stage flip-flop of said shift register circuit; for switching a first circuit connection for selecting an output of the predetermined-stage flip-flop to a second circuit connection for selecting a pulse signal obtained by bypassing the start pulse inputted to the first-stage flip-flop or vice versa, according to an aspect ratio of a display picture; and for transmitting the selected signal to the succeeding-stage flip-flop.

Further, it is preferable that said logic circuit further comprises means for, when said switching means switches the first circuit connection to the second connection for selecting the bypassed pulse signal, inhibiting the second timing signals from being outputted on the basis of the outputs of a plurality of said flip-flops including the first to predetermined stage flip-flops.

Further, it is preferable that said display panel section comprises: an array substrate formed with said pixel electrodes, said switching elements, said scanning lines, and said video signal lines; an opposing substrate formed with said opposing electrodes; and a liquid crystal layer sandwiched between said array substrate and said opposing substrate.

Further, it is preferable that said video signal line driving circuit is formed on said array substrate.

Further, the second aspect of the present invention provides a display device, comprising: a display panel section including: a plurality of pixel electrodes arranged in a matrix pattern; a plurality of switching elements each arranged in correspondence to each pixel electrode; a plurality of scanning lines each connected in common to said switching elements corresponding to said pixel electrodes arranged in a same row direction, for transmitting a control signal for opening and closing said common-connected switching elements simultaneously; a plurality of video signal lines for transmitting video signals to said pixel electrodes arranged in a same column direction via said corresponding switching elements, respectively; and a plurality of opposing electrodes each arranged so as to be opposed to each of said pixel electrodes; a scanning line driving circuit including: a plurality of logic circuits, each for selecting a scanning line during a first period, when a reset signal is not received; and for selecting another scanning line during a second period different from the first period when the reset signal is received; and a plurality of buffer amplifier circuits, each for supplying the control signal to the selected scanning line on the basis of an output of said logic circuit.

Here, it is preferable that said logic circuit selects the scanning line on the basis of an m-bit address signal and the reset signal.

Further, it is preferable that said logic circuits comprise: a shift register circuit composed of a plurality of cascade-connected flip-flops and responsive to a start pulse, for transferring the start pulse to the succeeding-stage flip-flop in sequence in synchronism with a clock signal; and a reset circuit for outputting a signal for selecting the scanning line on the basis of an output of each-stage flip-flop of said shift register circuit and the reset signal.

Further, it is preferable that the display device further comprises switching means connected between a predetermined-stage flip-flop and the succeeding-stage flip-flop of said shift register circuit; for switching a first circuit connection for selecting an output of the predetermined-stage flip-flop to a second circuit connection for selecting a pulse signal obtained by bypassing the start pulse inputted to the first-stage flip-flop or vice versa, according to an aspect ratio of a display picture; and for transmitting the selected signals to the succeeding-stage flip-flop.

Further, it is preferable that said logic circuit further comprises means for, when said switching means switches the first circuit connection to the second circuit connection for selecting the bypassed pulse signal, inhibiting the signals for selecting the scanning lines from being outputted on the basis of the outputs of a plurality of said flip-flops including the first stage to predetermined stage flip-flops.

Further, it is preferable that said display panel section comprises: an array substrate formed with said pixel electrodes, said switching elements, said scanning lines, and said video signal lines; an opposing substrate formed with said opposing electrodes; and a liquid crystal layer sandwiched between said array substrate and said opposing substrate.

Further, it is preferable that said video signal line driving circuit is formed on said array substrate.

Further, the third aspect of the present invention provides a driving method for the display device, wherein the non-display data are written during one horizontal blanking period, and the video data are written during one horizontal scanning period.

Here, it is preferable that polarity of signals of the non-display data written during one horizontal blanking period is the same as that of signals of the video data written during one horizontal scanning period.

Further, it is preferable that when the non-display data are displayed, a potential difference between the pixel electrode and the opposing electrode different from that used for the video data display is used.

Further, the fourth aspect of the present invention provides a method of driving a display device for forming display picture based upon video data on a display panel on which a plurality of horizontal pixel lines each composed of a plurality of display pixels are arranged, comprising the steps of: when the number of horizontal pixel lines during one vertical scanning period including one vertical blanking period of the video data is smaller than a total number of the horizontal lines on the display panel, writing non-display data in a plurality of horizontal pixel lines not corresponding to the video data simultaneously for a first period; and writing the video data in at least one horizontal pixel line corresponding to the video data for a second period different from the first period.

Here, it is preferable that the first period is one vertical blanking period, and the second period is one vertical scanning period.

DETAILED DESCRIPTION OF THE PREFERRED EMBODIMENTS

Embodiments of the display device according to the present invention will be described hereinbelow with reference to the attached drawings.

(1st Embodiment)

Figure 1:
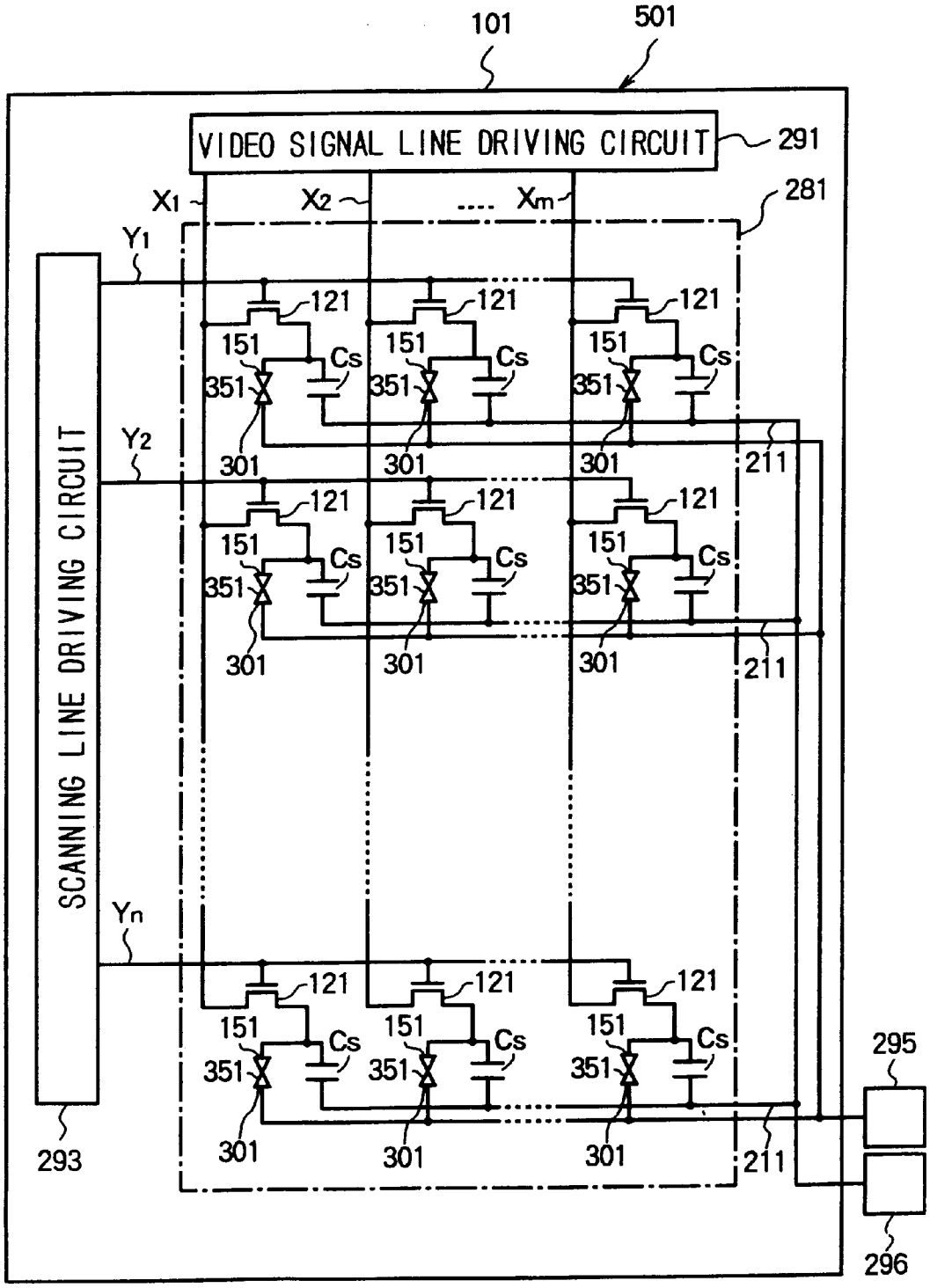
FIG. 1 is a block diagram showing a first embodiment of the display device according to the present invention.

FIG. 1 is a block diagram showing the first embodiment of the display device according to the present invention. In this embodiment, a display device 501 is a liquid crystal display device used for a projector type EDTV (extended definition television), in which a display area 281 having a diagonal line of 3 inches is shown.

In this liquid crystal display device 501, a TN (Twisted Nematic) type liquid crystal layer 351 is held between a matrix array substrate 101 and an opposing substrate (not shown) via an orientation film formed of polyimide.

As shown in FIG. 1, the display area 281 is formed at the central portion of a matrix array substrate 101, and a video signal line driving circuit 291 and a scanning line driving circuit 293 are both formed together at the periphery of the display area 281 on the same matrix array substrate 101. Further, an opposing electrode driving circuit 295 and a pixel potential holding capacity line driving circuit 296 are arranged on the outside of the matrix array substrate 101. In the display area 281, m-units of video signal lines $X_1, \ldots, X_m$ all connected to the video signal line driving circuit 291 are arranged in parallel to each other at regular intervals. Further, n-units of scanning lines $Y_1, \ldots, Y_n$ all connected to the scanning line driving circuit 293 are arranged roughly perpendicular to the video signal line $X_i$ (i=1, . . . , m), respectively.

On the other hand, an n-channel TFT 121 is arranged at each intersection between each scanning line $Y_j$ (j=1, . . . , n) and each video signal line $X_i$ (i=1, . . . , m). Further, a pixel electrode 151 formed of ITO (indium tin oxide) is arranged via this TFT 121. Further, each TFT 121 is connected to each corresponding video signal line $X_i$ (i=1, . . . , m). Further, a holding capacity line 211 (having a capacity Cs) for holding a pixel potential is connected to each pixel electrode 151 roughly in parallel to the scanning line $Y_j$ (j=1, . . . , n).

The opposing substrate is a transparent glass, on which an opposing electrode 301 formed of ITO and connected to an opposing electrode driving circuit 295 electrically and further an orientation film formed on the opposing electrode 301 are both formed. In addition, although not shown, a light shading layer formed of a metal (e.g., Chromium Cr) is provided to shade unnecessary light allowed to be incident upon the TFTs 121, When a picture is displayed by the pixels on the basis of video signals, the scanning line driving circuit 293 outputs a gate-on voltage Vg to the scanning lines $Y_1, Y_2, \ldots, Y_n$ in sequence. In response to this gate-on voltage Vg, each TFT 121 is turned on between the drain and the source thereof, so that the a video signal $V_s$ can be applied from the video signal line $X_i$ (i=1, . . . , m) to each pixel electrode 151 through each corresponding TFT 121, so that a potential generated between the opposing electrode and the pixel electrode 151 is applied to the liquid crystal layer 351. As a result, a display can be obtained on the basis of this potential difference, and further a charge is held between the pixel electrode 151 and the holding capacity line 211. Since the charge can be held, it is possible to suppress the fluctuations of the charge held by the liquid crystal layer 351, so that a display image can be maintained for each field period.

Figure 2:
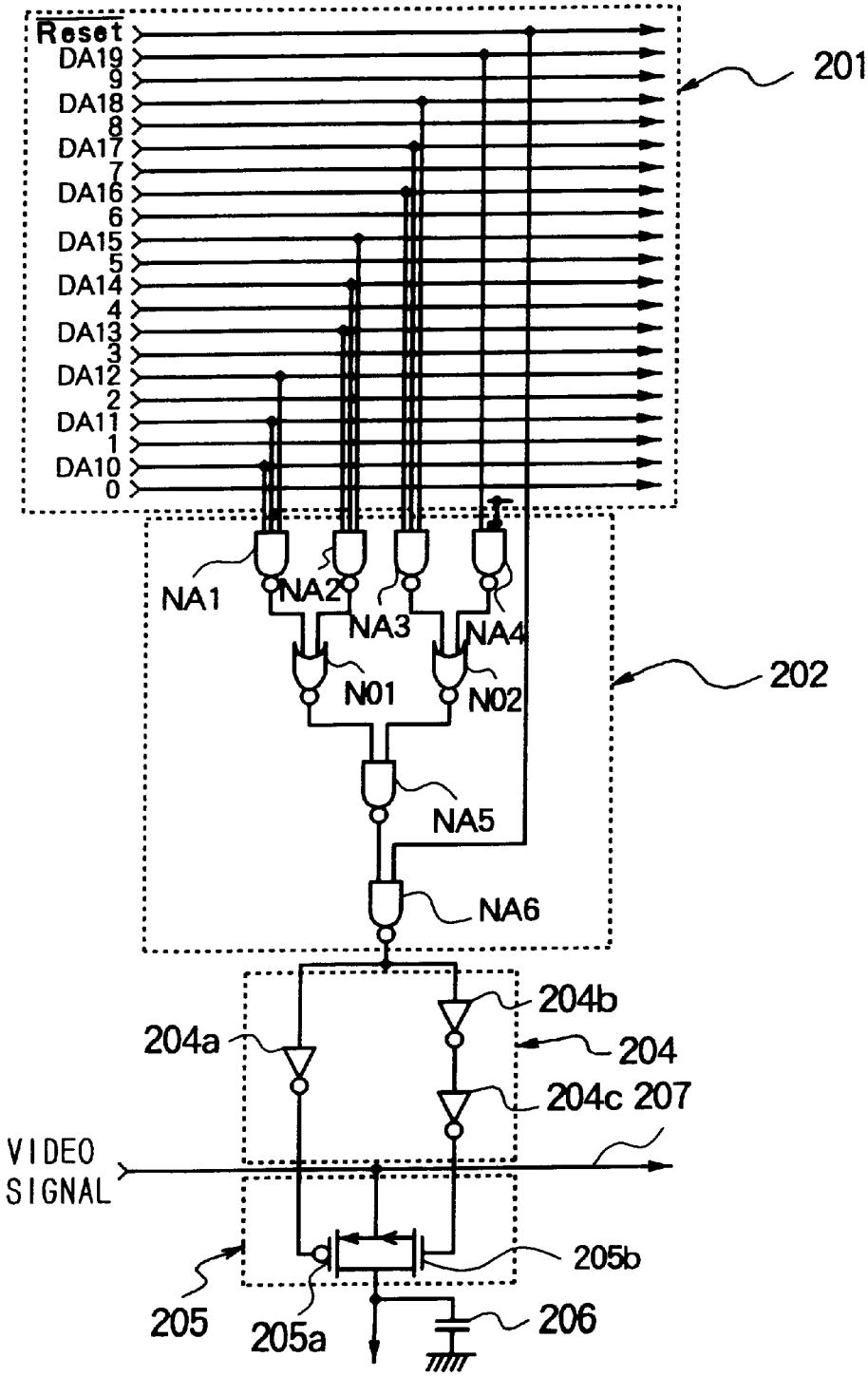
FIG. 2 is a practical circuit diagram showing the video signal line driving circuit of the first embodiment of the display device shown in FIG. 1.

With reference to FIG. 2, the construction of the video signal line driving circuit 291 of the first embodiment of the liquid crystal display device 501 will be described hereinbelow. As shown in FIG. 2, the video signal line driving circuit 291 is composed of a matrix wiring section 201, a logic circuit 202, a buffer amplifier circuit 204 connected to the logic circuit 202, a video signal selecting circuit 205 connected to the buffer amplifier circuit 204, and a holding capacity 206 connected to the video signal selecting circuit 205. Here, the logic circuit 202, the buffer amplifier circuit 204, the video signal selecting circuit 205, and the holding capacity 206 are all provided for each video signal line.

The matrix wiring section 201 has 21 wires, for instance when address signals for selecting the video signal line $X_i$ (i=1, . . . , m) are $A_0, \ldots, A_9$ ($A_i$ (i=0, . . . , 9) has a value of 0 or 1). A reset signal is inputted to one of these 21 wires, and an address signal represented by numerical values $D_0$ to $D_9$ of 10 bits $A_0$ to $A_9$ and numerical values $D_{10}$ to $D_{19}$ of the inverted values of these 10 bits $A_0$ to $A_9$ are inputted to the remaining 20 wires.

Further, the logic circuit 202 is provided with four three-input NAND gates NA1, NA2, NA3 and NA4; and two two-input NAND gates NA5 and NA6; and two two-input NOR gates NO1 and NO2. To these four three-input NAND gates NA1, NA2, NA3 and NA4, the digital numerical values of DA0 to DA9 or the inverted digital numerical values of DA10 to DA19 are inputted for each bit one by one. The outputs of the two three-input NAND gates NA1 and NA2 are connected to the two input terminals of the NOR gate NO1, and the outputs of the two three-input NAND gates NA3 and NA4 are connected to two input terminals of the NOR gate N02. Further, the outputs of the two two-input NOR gates NO1 and NO2 are connected to two input terminals of the NAND gate NA5. Further, the output of the NAND gate NA5 and the reset signal are both connected to the two input terminals of the NAND gate NA6. The output of the final-stage NAND gate NA6 of the logic circuit 202 is a sampling pulse. The output of the NAND gate NA6 is connected to the buffer amplifier circuit 204.

The buffer amplifier circuit 204 has three buffers 204*a*, 204*b* and 204*c*. The output of the NAND gate NA6 is inversely amplified by the buffer 204*a*, and this inverse-amplified signal is inputted to the gate of a p-channel TFT 205*a* of a transfer gate for constituting the video signal selecting circuit 205.

The output of the NAND gate NA 6 is amplified by the amplifier circuit composed of the series-connected buffers 204*b* and 204*c*, and this amplified signal is inputted to the gate of an n-channel TFT 205*b* of the transfer gate for constituting the video signal selecting circuit 205. Further, the transfer gate composed of the two TFTs 205*a* and 205*b* is used to select video signals The drain of this transfer gate is connected to a video signal bus line 207, so that the video signals can be sampled during the on-period of the sampling pulse applied by the logic circuit 202. The source of the transfer gate is connected to the corresponding video signal line and further to the holding capacity 206 for holding the video signal selected by the video signal selecting circuit 205.

With reference to FIG. 2, the operation of this video signal line driving circuit 291 will be described hereinbelow. Here, in the matrix wiring section 201, the combinations of the numerical signal lines connected to the three-input NAND gates NA1, NA2, NA3 and NA4 are different, respectively.

To the NAND gate NA1, any one of the digital numerical value signal DA0 and the inverted signal DA10, any one of the digital numerical signal DA1 and the inverted signal DA11, and any one of the digital numerical signal DA2 and the inverted signal DA12 are inputted. To the NA2, any one of the digital numerical value signal DA3 and the inverted signal DA13, any one of the digital numerical signal DA4 and the inverted signal DA14, and any one of the digital numerical signal DA5 and the inverted signal DA15 are inputted. To the NA3, any one of the digital numerical value signal DA6 and the inverted signal DA16, any one of the digital numerical signal DA7 and the inverted signal DA17, and any one of the digital numerical signal DA8 and the inverted signal DA18 are inputted. Further, any one of the digital numerical signal DA9 and the inverted signal DA19 is inputted to one of the three input terminals of the NAND gate NA4, and further a signal of [H] is always inputted to the remaining two input terminals thereof, Further, the other input terminal of the NAND gate NA6 is connected to the rest signal line.

In the video signal line driving circuit 291 constructed as described above, only when all the inputs of the four NAND gates NA1, NA2, NA3 and NA4 are at [H] level, the NAND gate NA5 of the logic circuit (decoder) 202 outputs [L] level output. When the video signal data are written in the display area, the reset signal is at [H] level. For this reason, the sampling pulse is outputted from the final-stage NAND gate NA6 of the logic circuit 202 to the buffer amplifier circuit 204. Therefore, the video signal is selected and outputted from the video signal selecting circuit 205.

In contrast with this, when the non-displayed data are written in the display area, since the reset signal is at [L] level, the sampling pulse is outputted from the final-stage NAND gate NA6 of the logic circuit 202 to the buffer amplifier circuit 204, irrespective of the inputs of the NAND gates of NA1, NA2, NA3 and NA4.

In synchronism with the [L] level of the reset signal, when the necessary non-display data are supplied from the video signal bus line 207, the non-displayed video signals are outputted from all the video signal selecting circuits 205.

The operation of the liquid crystal display device according to the present invention will be described hereinbelow with reference to FIG. 3, by taking the case where a display picture is constructed by a display area 502 composed of 640×480 pixels, a first non-display area 503 composed of 107×480 pixels, and a second non-display area 504 composed of 106×480 pixels. In this example, the liquid crystal display device has 853-units of the video signal lines and 480-units of the scanning lines.

At time $t_0$, since the [H] level voltage Vg(N−1) is outputted from the scanning line driving circuit 293 to the (N−1)-th scanning line $Y_{N-1}$, the TFTs 121 connected to this scanning line $Y_{N-1}$ are all turned on. Under these conditions, the address signals are transmitted to the matrix wiring section 201 of the video signals line driving circuit 291 in such a way that the logic circuits 202 connected between the 108th video signal line $X_{108}$ and the 747th video signal line $X_{747}$ output the sampling pulses in sequence. Then, video signals are transmitted from the video signal line driving circuit 291 to the video signal lines $X_{108}$ to $X_{747}$ in sequence, so that the video signal data are written in the corresponding pixel electrodes 151 via the TFTs 121 connected to the scanning line $Y_{N-1}$ (for one horizontal scanning period shown in FIG. 3). Therefore, the display data are displayed on the pixels arranged on the (N−1)-th line from above the display area 502 shown in FIG. 4.

Figure 3:
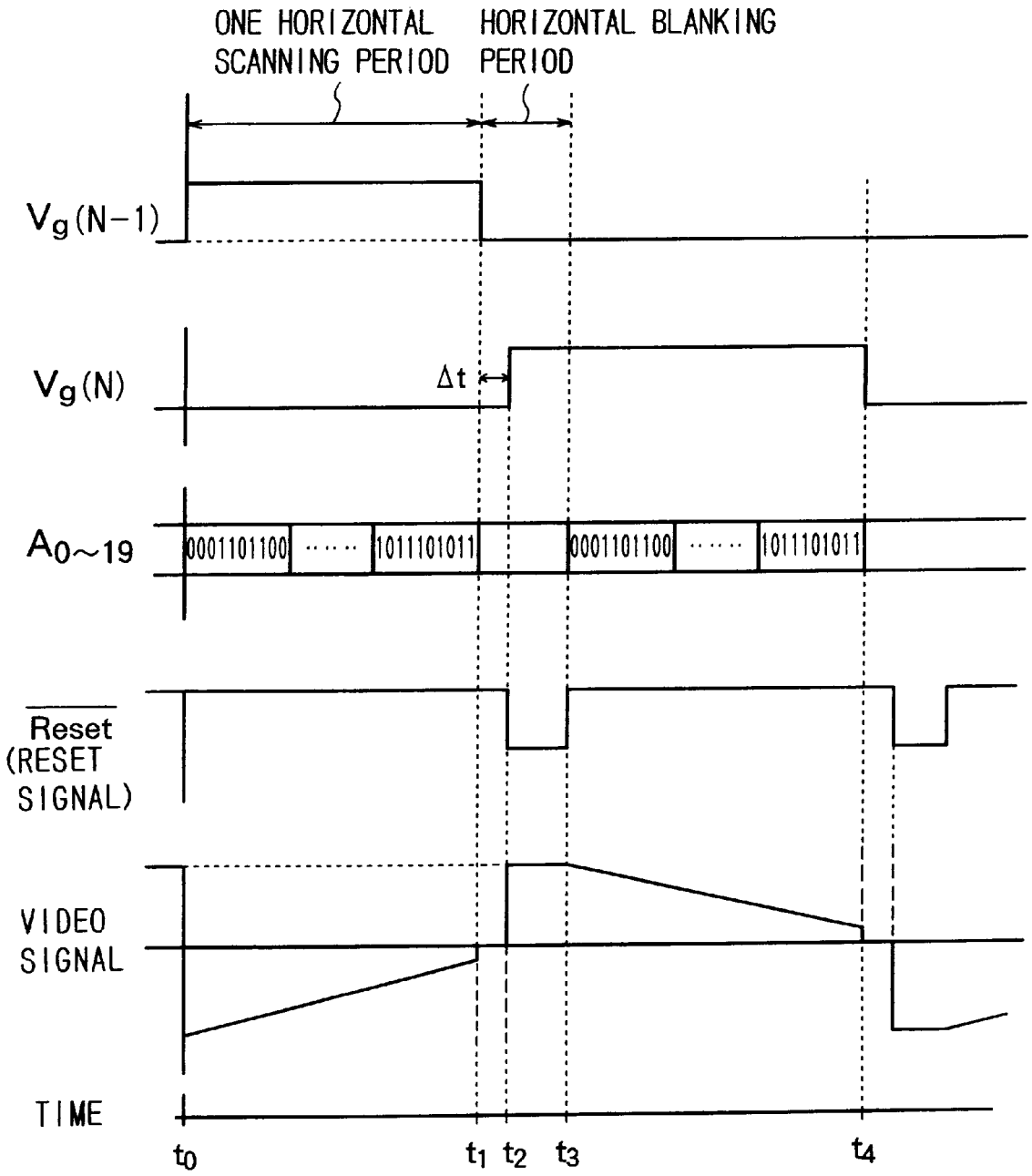
FIG. 3 is a drive timing chart of the first embodiment of the display device according to the present invention.

Further, when a predetermined time Δt has elapsed after the voltage Vg(N−1) of the scanning line $Y_{N-1}$ changes to [L] level (at time $t_1$), the potential Vg(N) of the N-th scanning line $Y_N$ changes to [H] level and in addition the reset signal changes to [L] level (at time $t_2$ in FIG. 3). In this case, since the potential Vg(N) of the N-th scanning line $Y_N$ changes to [H] level, the TFTs 121 connected to the scanning line $Y_N$ are turned on. Under these conditions, when the reset signal is changed to [L] level and further the non-displayed data (e.g., black display potential) are supplied to the video signal bus line 207, the video signal data of non-display data are written in the m(853)-units of pixel electrodes 151 via the TFTs 121 connected to the scanning line $Y_N$.

At time $t_3$, when the horizontal blanking line period ends and thereby the reset signal is changed to [H] level, in the same way as above, the address signals are transmitted to the matrix wiring section 201 of the video signals line driving circuit 291 in such a way that the logic circuits 202 connected between the 108th video signal line $X_{108}$ and the 747th video signal line $X_{747}$ output the sampling pulses in sequence. Then, video signals are transmitted from the video signal line driving circuit 291 to the video signal lines $X_{108}$ to $X_{747}$ in sequence, so that the video signal data are written in the corresponding pixel electrodes 151 via the TFTs 121 connected to the scanning line $Y_N$.

Therefore, the non-displayed data (e.g., black display potential) are written in the pixel electrodes 151 corresponding to the pixels of the non-display areas 503 and 504 among the pixel electrodes corresponding to the N-th line pixels from above the display picture. Further, the display data are written in the pixel electrodes 151 corresponding to the pixels in the display area 502.

Therefore, it is possible to display the display data in the display area 502 and the non-display data (e.g., black) on the two non-displayed areas 503 and 504, respectively.

Further, the time Δt shown in FIG. 3 is added to prevent the timing at which the TFTs 121 controlled by the ($Y_{N-1}$)-th scanning line are turned off from being delayed by a time constant of the scanning line, so that the video signals to be written in the $Y_N$-th line are held by the pixel electrodes 151 of the $(Y_{N-1})$-th line.

As described above, in the first embodiment of the present invention, it is possible to write the non-display data in the signal line in the non-display areas for one horizontal blanking period, by changing only the reset signal, so that the non-display data can be displayed easily in the non-display areas, respectively.

Further, in the liquid crystal display device according to the present invention, when signals having the same polarity as that of the video signals written in the pixel electrodes in the same frame are designated and further written (i.e., precharged) as the non-display data for the horizontal blanking period, it is possible to write display data of high contrast.

Further, in the present embodiment, since the non-display data are written in all the pixels arranged in one horizontal line on the basis of the reset signal, when any desired display area is selected by the driving circuit in the horizontal direction of the display picture, the non-display data are already held at the pixel electrodes of the non-selected areas (i.e., the non-display areas). Therefore, it is possible to select any desired display area without processing the video signals.

(2nd Embodiment)

The second embodiment of the display device according to the present invention will be described hereinbelow with reference to FIGS. 5 and 6. The second embodiment of the liquid crystal display device is different from the first embodiment shown in FIGS. 1 and 2 in that the construction of the video signal line driving circuit 291 shown in FIG. 2 is replaced with that as shown in FIG. 5 and further in that the video signal bus lines 407A and 407B (shown in FIG. 5) are provided, instead of the video signal bus line 207 (shown in FIG. 2).

Figure 5:
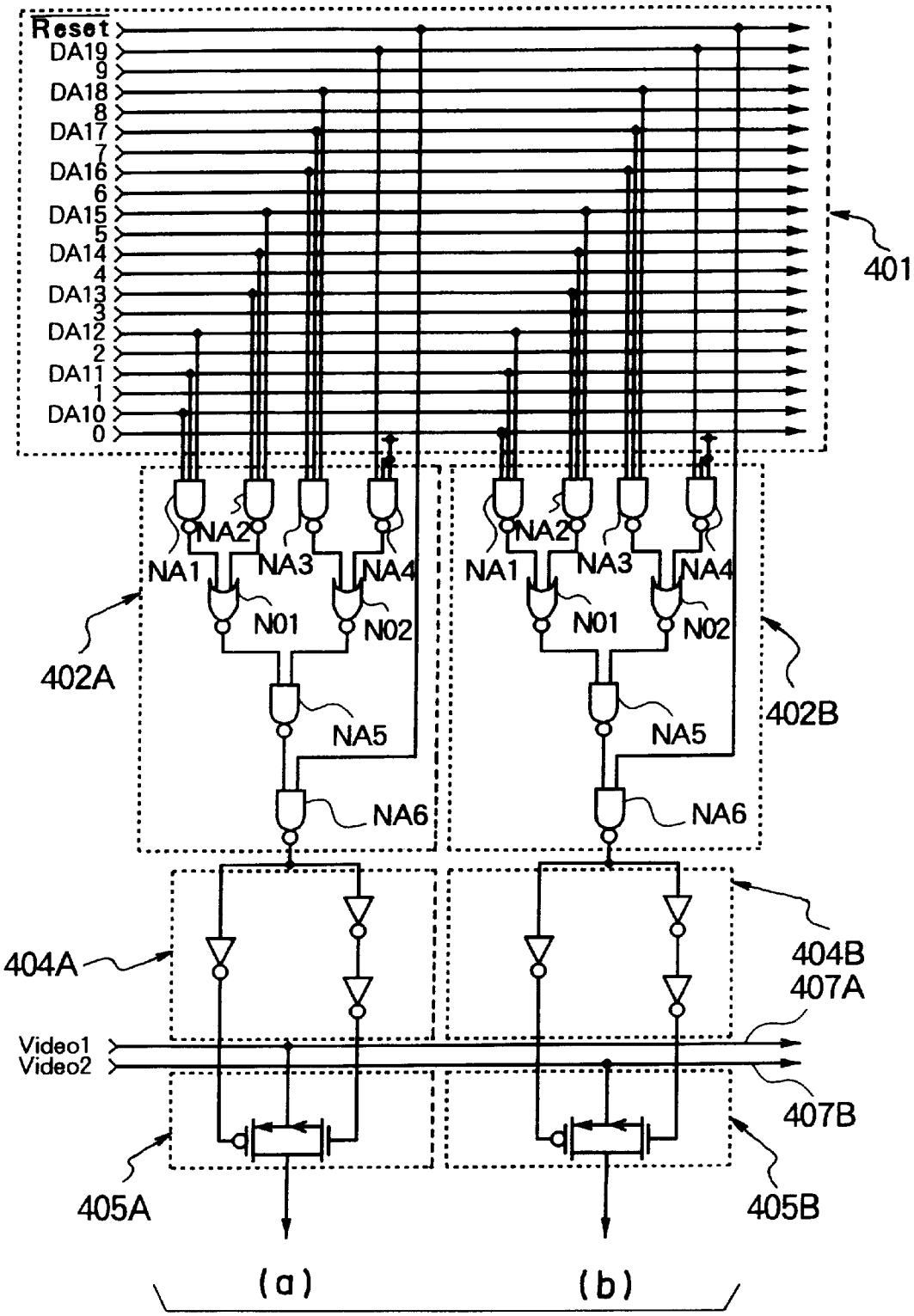
FIG. 5 is a practical circuit diagram showing the video signal line driving circuit of a second embodiment of the display device according to the present invention.

The video signal line driving circuit shown in FIG. 5 includes a matrix wiring section 401 and first and second driving sections. Here, the first driving section is used to drive the video signal lines of the display area and the second driving section is used to drive the video signal lines of the non-displayed areas.

As shown by (a) in FIG. 5, the first driving section is provided for each video signal line of the display area, which is composed of a logic circuit 402A, a buffer amplifier circuit 404A for receiving the output of the logic circuit 402A, and a video signal selecting circuit 405A for selecting one of video signals on the basis of the output of the buffer amplifier circuit 404A. Further, as shown by (b) in FIG. 5, the second driving section is provided for each video signal line of the non-display areas, which is composed of a logic circuit 402B, a buffer amplifier circuit 404B for receiving the output of the logic circuit 402B, and a video signal selecting circuit 405B for selecting one of video signals on the basis of the output of the buffer amplifier circuit 404B.

The matrix wiring section 401 is the same in construction as that 201 shown in FIG. 2. Further, the two logic circuits 402A and 402B are the same in construction as that 202 shown in FIG. 2, respectively. Further, the two buffer amplifier circuits 404A and 404B are the same in construction as that 204 shown in FIG. 2, respectively. Further, the matrix wiring section 401 and the logic circuit 402A are so connected in such a way that when addresses of the video signal lines to be driven are inputted to the matrix wiring section 401A, video data are transmitted to the video signal lines. Further, the matrix wiring section 401 and the logic circuit 402B are so connected in the same way as above. Further, in FIG. 5, the holding capacity to be connected to the video signal selecting circuit is not shown.

The buffer amplifier circuit 404A amplifies and inverts the output of the logic circuit 402A, and the buffer amplifier circuit 404B amplifies and inverts the output of the logic circuit 402B. Further, the video signal selecting circuit 405 has two transfer gates 405A and 405B. The transfer gate 405A selects one of video signals Video1 transmitted through a video signal bus line 407A on the basis of the output of the buffer amplifier circuit 404A, and the transfer gate 405B selects one of video signals Video2 transmitted through a video signal bus line 407B on the basis of the output of the buffer amplifier circuit 404B.

Figure 4:
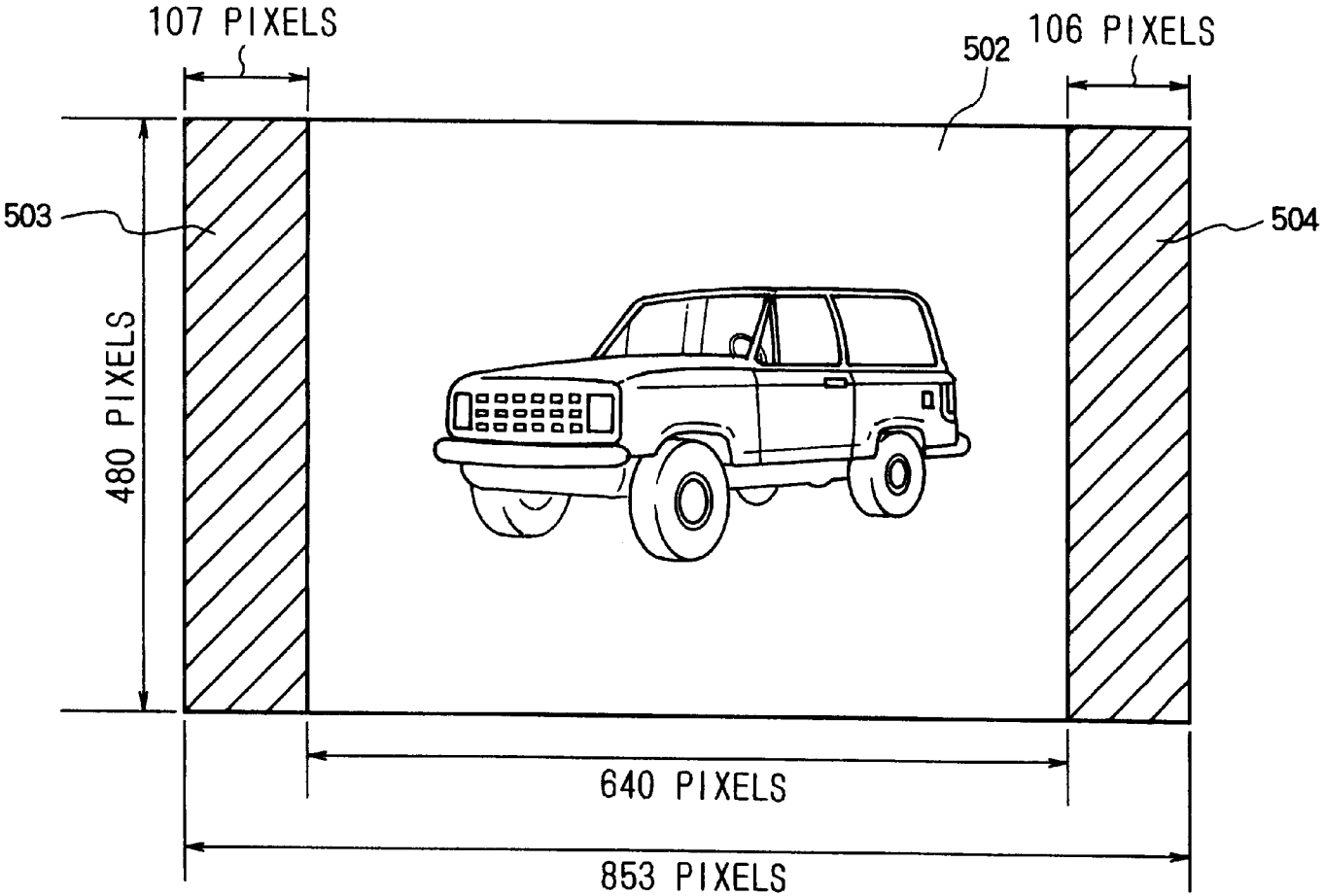
FIG. 4 is an example of pictures displayed by the display device according to the present invention.
Figure 6:
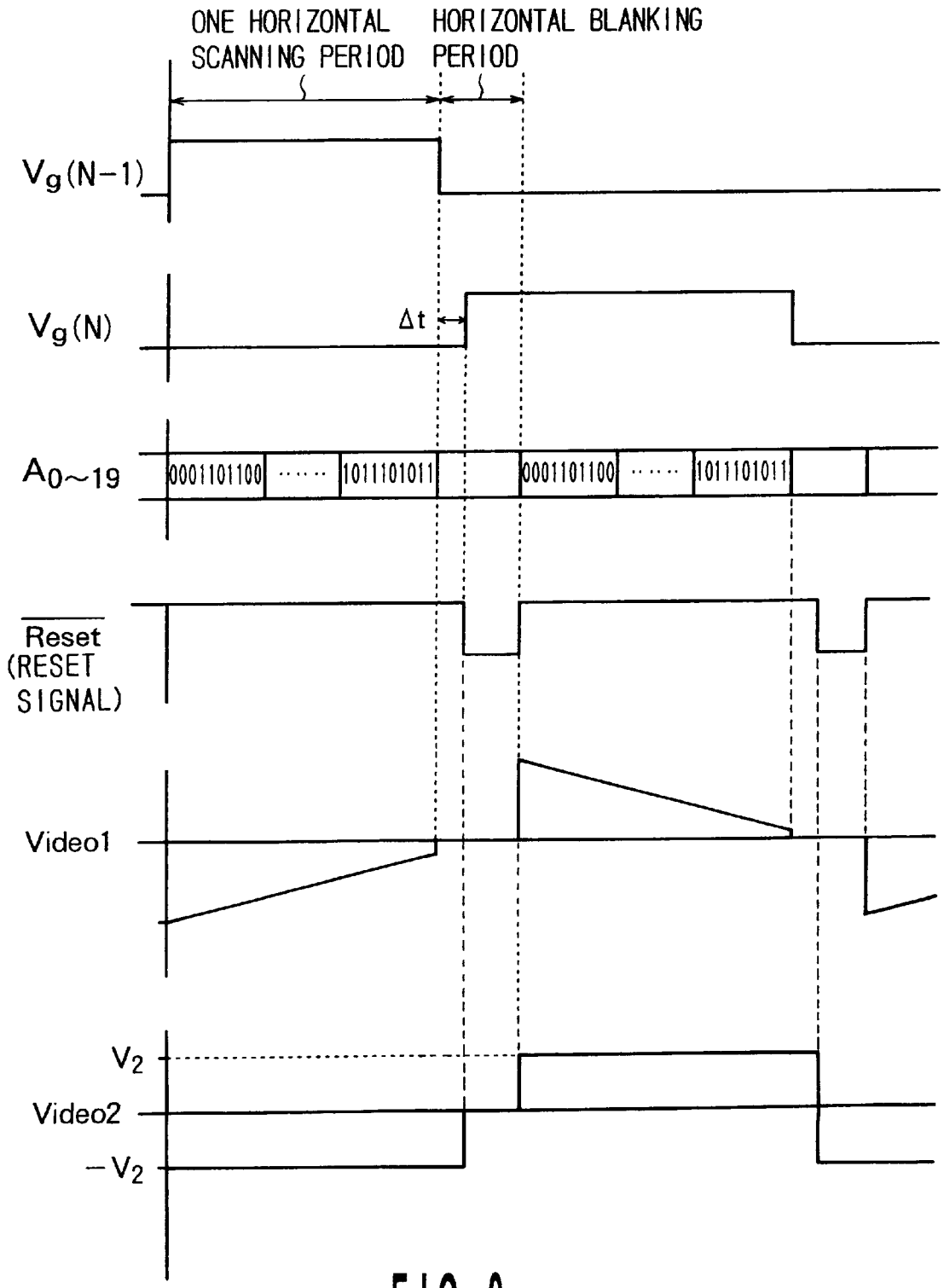
FIG. 6 is a drive timing chart of the second embodiment of the display device according to the present invention.
Figure 7:
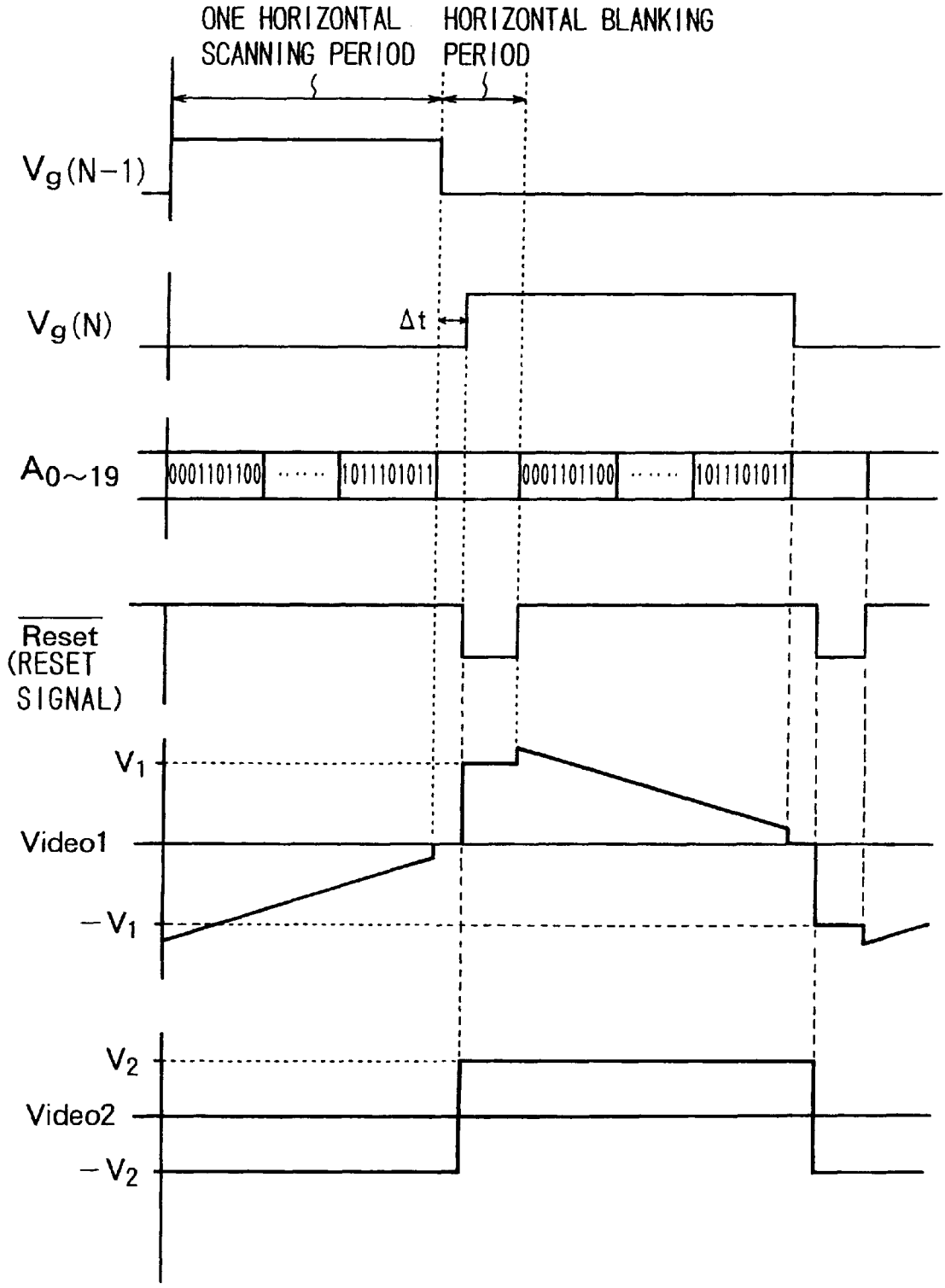
FIG. 7 is another drive timing chart of the second embodiment of the display device according to the present invention.

In the construction as described above, when the connection of the input wiring (video signal lines) of the TFTs 121 is previously divided into that for the video signal bus line 407A and that for the video signal bus line 407B, according to the data contents of the non-display data in the display panel, it is unnecessary to insert the non-display data into the video signals as shown in FIG. 6. Further, the other display data can be written at the same time for the horizontal blanking period, so that it is possible to set the voltage used for precharge of the display area and the voltage used for the non-display data in the non-display areas, separately in one horizontal pixel line. For instance, in the case of the display image as shown in FIG. 4, the video signal lines are connected in such a way that the video signals Video1 can be inputted to the signal lines corresponding to the display area 502, and the video signals Video2 can be inputted to the signal lines corresponding to the non-display area 503 and the non-display area 504. When the non-display data are not displayed, the videos signals Video1 are quite the same as the video signals Video2. However, when the non-display data are displayed, the videos signals Video1 are used as they are and the video signals Video2 are the non-display data. Further, when the display data are required to be inputted by setting the precharge voltage, the voltage of the video signals Video1 is set to $\pm V_1$ for the horizontal blanking period, as shown in FIG. 7.

In this second embodiment, it is possible to obtain the same effect as with the case of the first embodiment.

(3rd Embodiment)

The third embodiment of the display device according to the present invention will be described hereinbelow with reference to FIGS. 8 and 9. This third embodiment of the liquid crystal display device is different from the first embodiment shown in FIGS. 1 and 2 in that the construction of the video signal line driving circuit 291 is replaced with that as shown in FIG. 8 and further in that the video signal bus line 607 and two raster signal bus lines 608A and 608B are provided, instead of the video signal bus line 207 (shown in FIG. 2).

Figure 8:
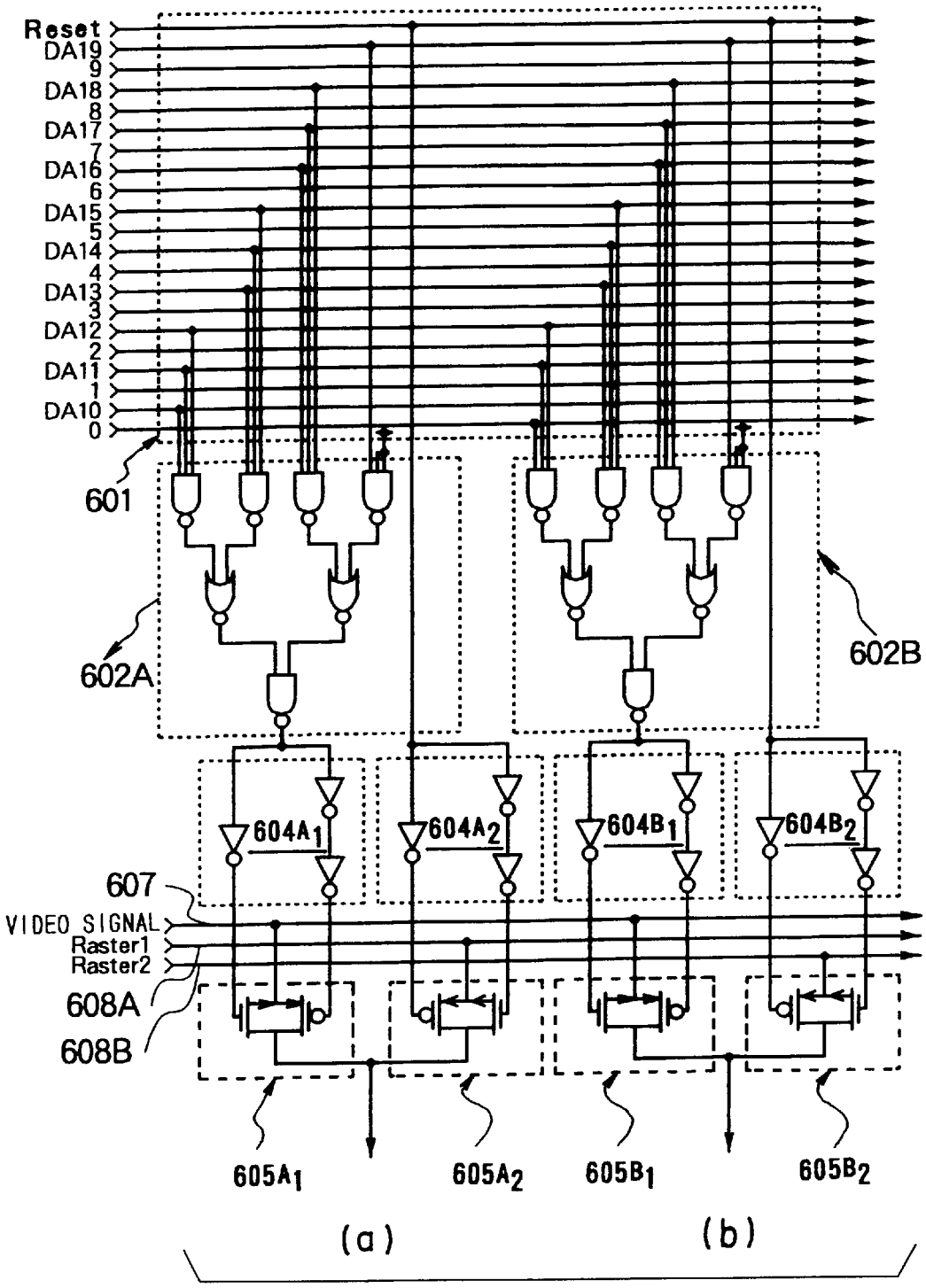
FIG. 8 is a practical circuit diagram showing the video signal line driving circuit of a third embodiment of the display device according to the present invention.

The video signal line driving circuit shown in FIG. 8 includes a matrix wiring section 601 and first and second driving sections.

As shown by (a) in FIG. 8, the first driving section is provided for each video signal line, and composed of a logic circuit 602A, two buffer amplifier circuits 604$A_1$ and 604$A_2$, and two video signal selecting circuits 605$A_1$ and 605$A_2$ each composed of a transfer gate. Further, as shown by (b) in FIG. 8, the second driving section is provided for each video signal line, and composed of a logic circuit 602B, two buffer amplifier circuits 604$B_1$ and 604$B_2$, and two video signal selecting circuits 605$B_1$ and 605$B_2$ each composed of a transfer gate. Further, the holding capacity is not shown in FIG. 8.

The matrix wiring section 601 is the same in construction as that 201 shown in FIG. 2. Further, the two logic circuits 602A and 602B are the same in construction as that 202 shown in FIG. 2, respectively excepting the NAND gate NA6 is removed, and the four buffer amplifier circuits 604$A_1$, 604$A_2$, 604$B_1$ and 604$B_2$ are the same in construction as that 204 shown in FIG. 2, respectively. Further, each of the buffer amplifier circuits 604$A_2$ and 604$B_2$ amplifies and inverts each reset signal (a positive logic in this embodiment).

The transfer gate 605$A_1$ selects one of the video signals transmitted through the video signal bus line 607 on the basis of the output of the buffer amplifier circuit 604$A_1$, and the transfer gate 605$B_1$ selects one of the video signals transmitted through the video signal bus line 607 on the basis of the output of the buffer amplifier circuit 604$B_1$. Further, the transfer gate 605$A_2$ selects the raster signal Raster1 transmitted through the raster signal bus line 608A on the basis of the output of the buffer circuit 604$A_2$; and the transfer gate 605$B_2$ selects the raster signal Raster2 transmitted through the raster signal bus line 608B on the basis of the output of the buffer amplifier circuit 604$B_2$.

Figure 9:
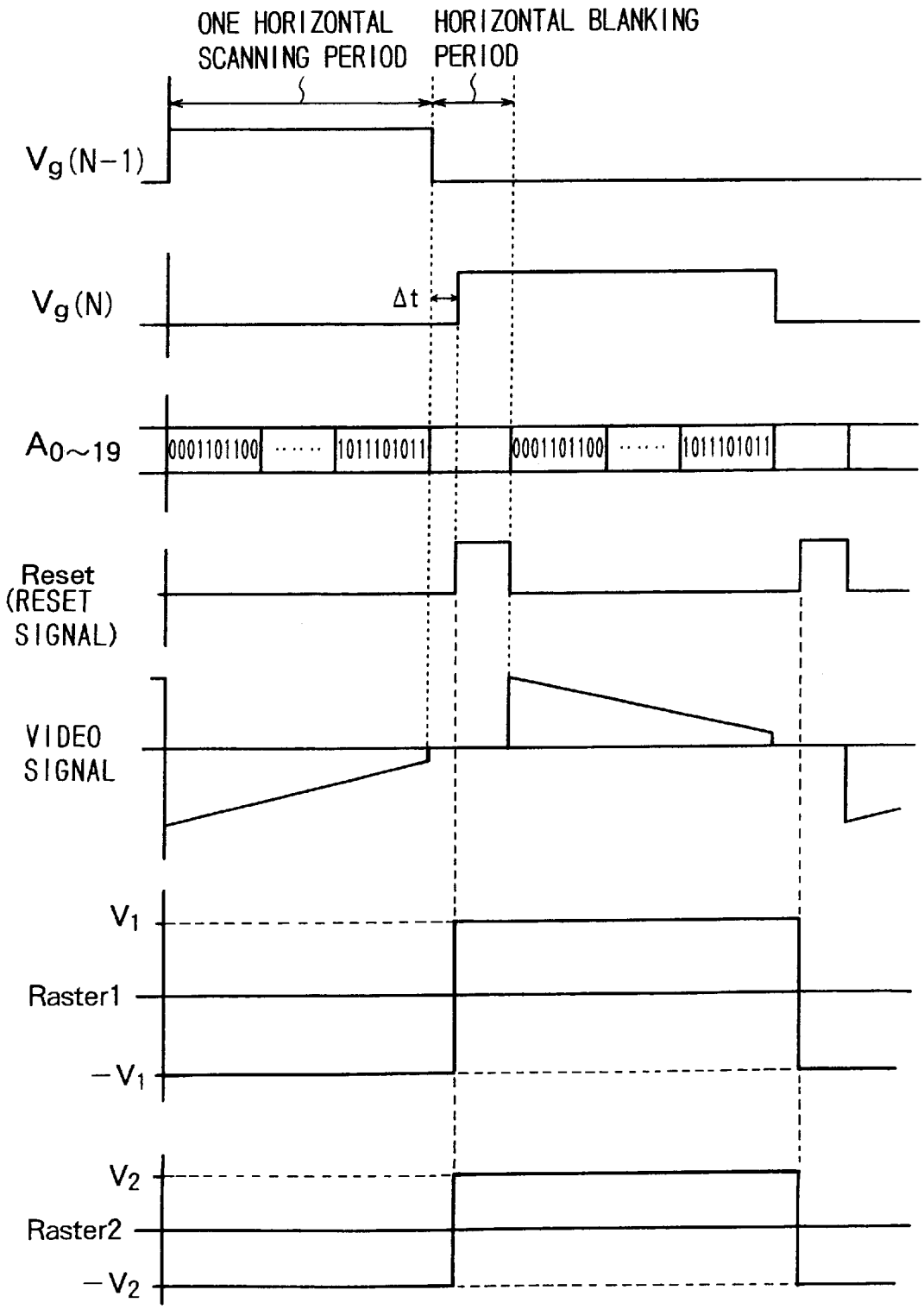
FIG. 9 is a drive timing chart of the third embodiment of the display device according to the present invention.

In the construction as described above, it is possible to input the raster signal Raster1 or Raster2 indicative of the non-display data or the precharge voltage, separately from the video signals indicative of the display data, so that it is unnecessary to modify the data of the video signals for the horizontal blanking period, as shown in FIG. 9. In addition, since the raster signal Raster1 and the raster signal Raster2 are both supplied through two different wires, it is possible to set and input the non-display data and the precharge voltage separately to each horizontal pixel line, in the same way as with the case of the second embodiment.

In this third embodiment, it is possible to obtain the same effect as with the case of the first embodiment.

(4th Embodiment)

In the first, second and third embodiments of the display device according to the present invention, the logic circuit is arranged for each video signal line. Without being limited, thereto, it is possible to drive a plurality of video signal lines at the same time by use of a single logic circuit, as described hereinbelow.

Figure 10:
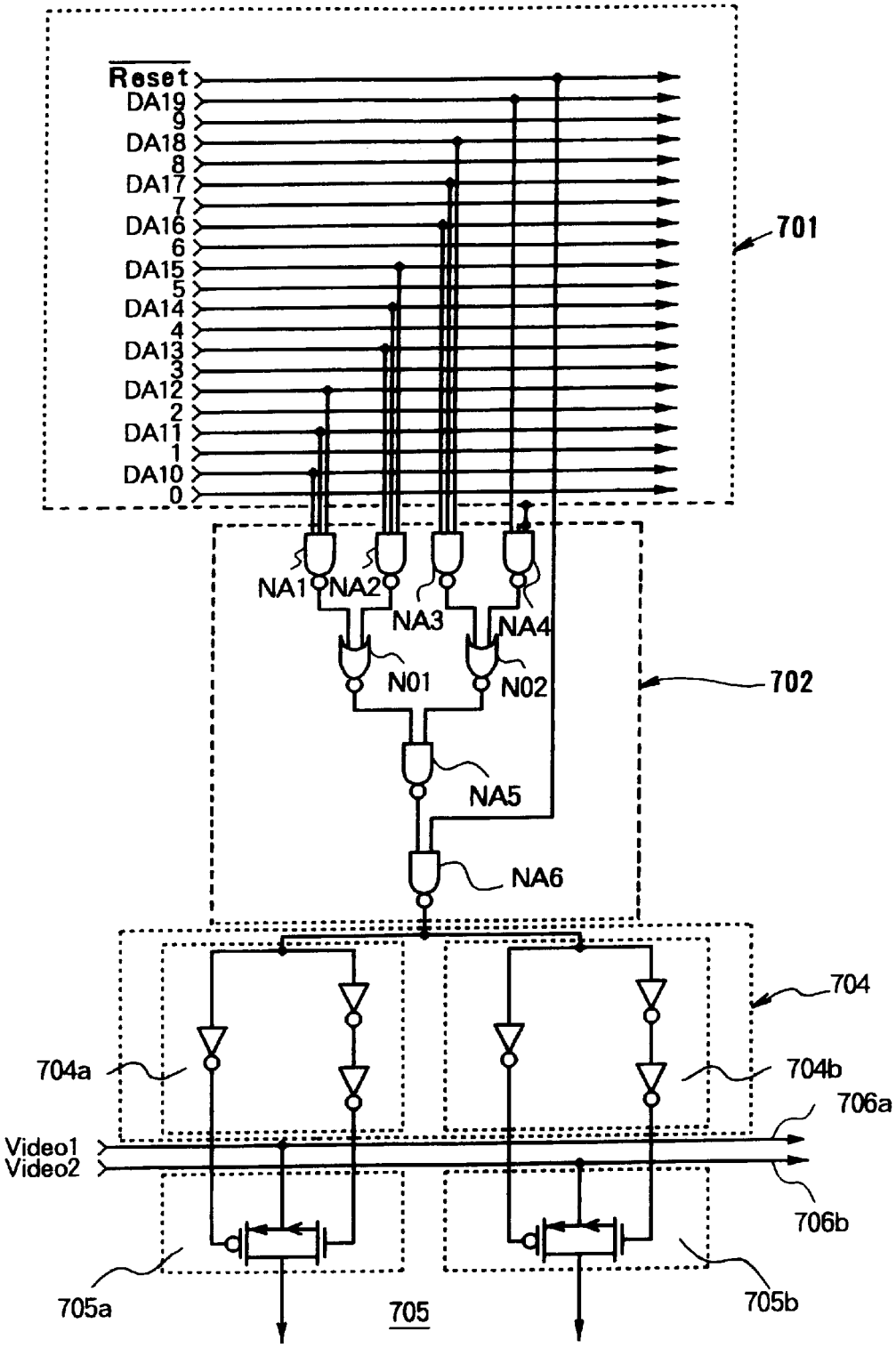
FIG. 10 is a practical circuit diagram showing the video signal line driving circuit of a fourth embodiment of the display device according to the present invention.
Figure 11:
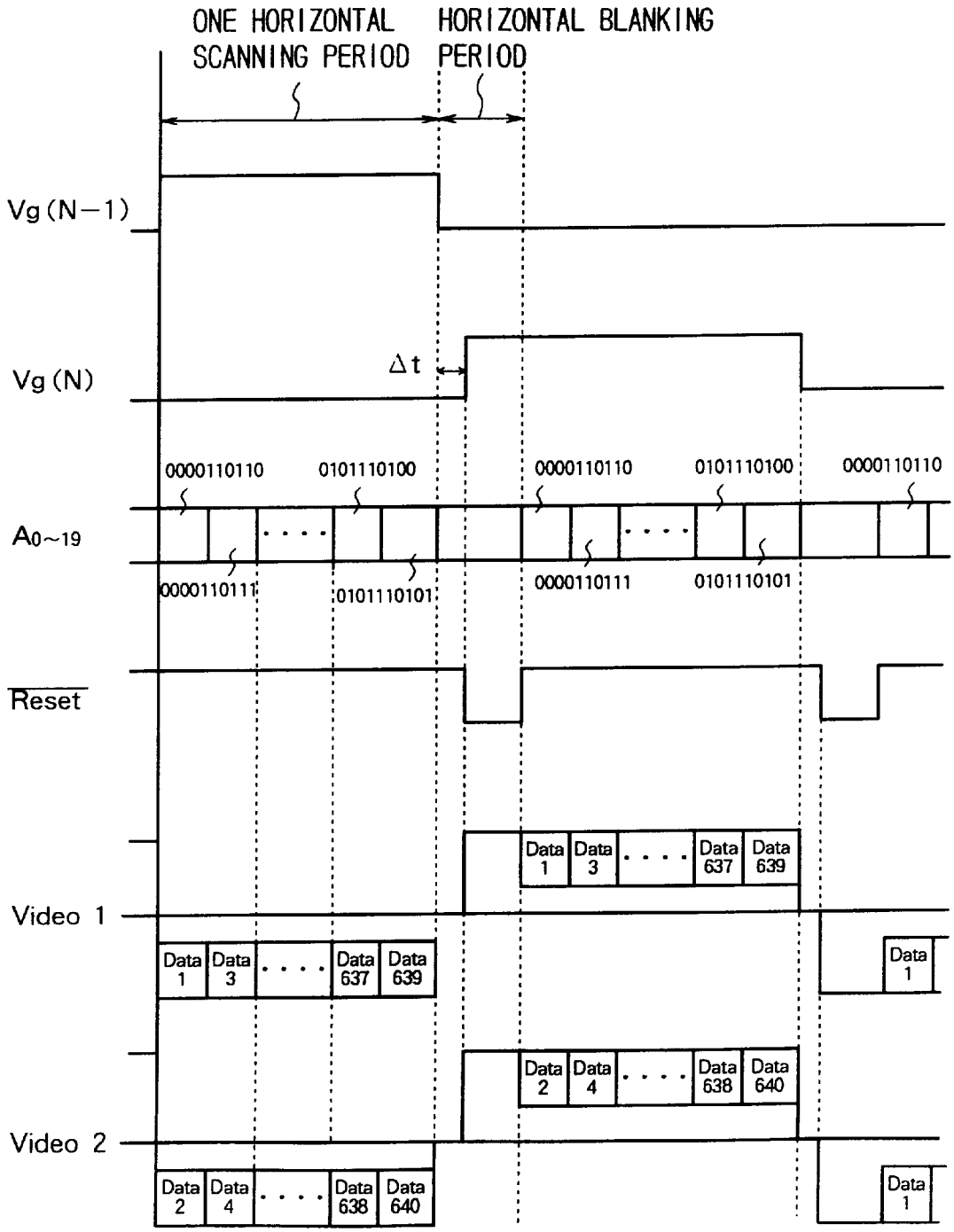
FIG. 11 is a drive timing chart of the fourth embodiment of the display device according to the present invention.

The fourth embodiment of the display device according to the present invention will be described hereinbelow with reference to FIGS. 10 and 11. This fourth embodiment of the liquid crystal display device is different from the first embodiment shown in FIGS. 1 and 2 in that the buffer amplifier section 204 and the video signal selecting circuit section 205 are replaced with the buffer amplifier section 704 and the video signal selecting circuit 705 as shown in FIG. 10.

The buffer amplifier section 704 is composed of two buffer amplifier circuits 704*a* and 704*b*, and the video signal selecting circuit section 705 is composed of a video signal selecting circuit 705*a* having a transfer gate and a video signal selecting circuit 705*b* having a transfer gate.

The sampling pulse outputted by the logic circuit 702 is inputted to the two buffer amplifier circuits 704*a* and 704*b*. The two buffer amplifier circuits 704*a* and 704*b* amplify and invert the sampling pulse and then input the amplified and inverted sampling pulse to the two transfer gates 705*a* and 705*b*, respectively. The transfer gate 705*a* selects the video signal Video1 transmitted through the video signal bus line 706*a*, and the transfer gate 705*b* selects the video signal Video2 transmitted through the video signal bus line 706*b*. Further, as shown in FIG. 11, the video signals to be written in the odd number video signal lines are supplied to the video signal bus line 706*a*, and the video signals to be written in the even number video signal lines are supplied to the video signal bus line 706*b*. In FIG. 11, however, since it is difficult to represent the waveforms of the video signals Video1 and Video2 in correspondence to the signal contents of the odd- or even-number video signal lines, both the waveforms are shown only in the form of simplified illustration.

In the same way as with the case of the first embodiment, only when the digital numerical signals to be inputted to the four NAND gates NA1, NA2, NA3 and NA4 are all at [H], the sampling signal is outputted from the logic circuit 702, and the video signals are selected and further outputted. Further, in response to the [L] level of the reset signal, the necessary non-display data are supplied through the video signal bus lines 706*a* and 706*b*, so that the non-display video signals are outputted from the video signal selecting circuit 705 corresponding to all the video signal lines. Further, in this fourth embodiment, it is possible to realize the same display as with the case of the first embodiment by use of the frequencies half lower than those of the digital input signals D0 to D19 and the video signals. Further, when the driving method as described above is adopted, the video signals can be written in the transfer gates sufficiently, Further, the driving method of the fourth embodiment can be of course applied to the second and third embodiments, without being limited only to the first embodiment.

(5th Embodiment)

In the first to fourth embodiments, although the non-display data are selected on the basis of the reset signal, it is possible to display the non-display data without use of the circuit for selecting the non-display data on the basis of the reset signal, as described hereinbelow.

Figure 12:
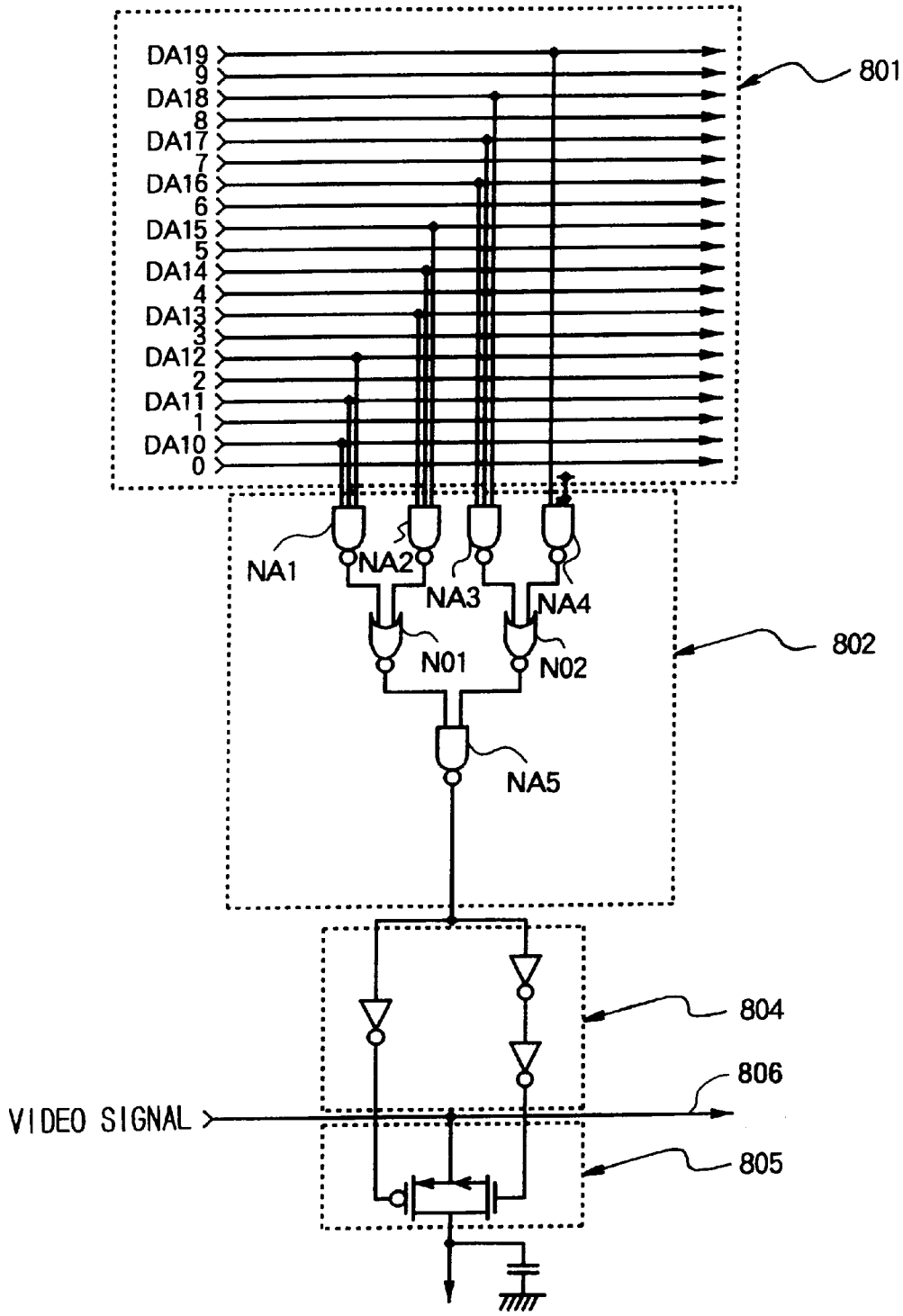
FIG. 12 is a practical circuit diagram showing the video signal line driving circuit of a fifth embodiment of the display device according to the present invention.
Figure 13:
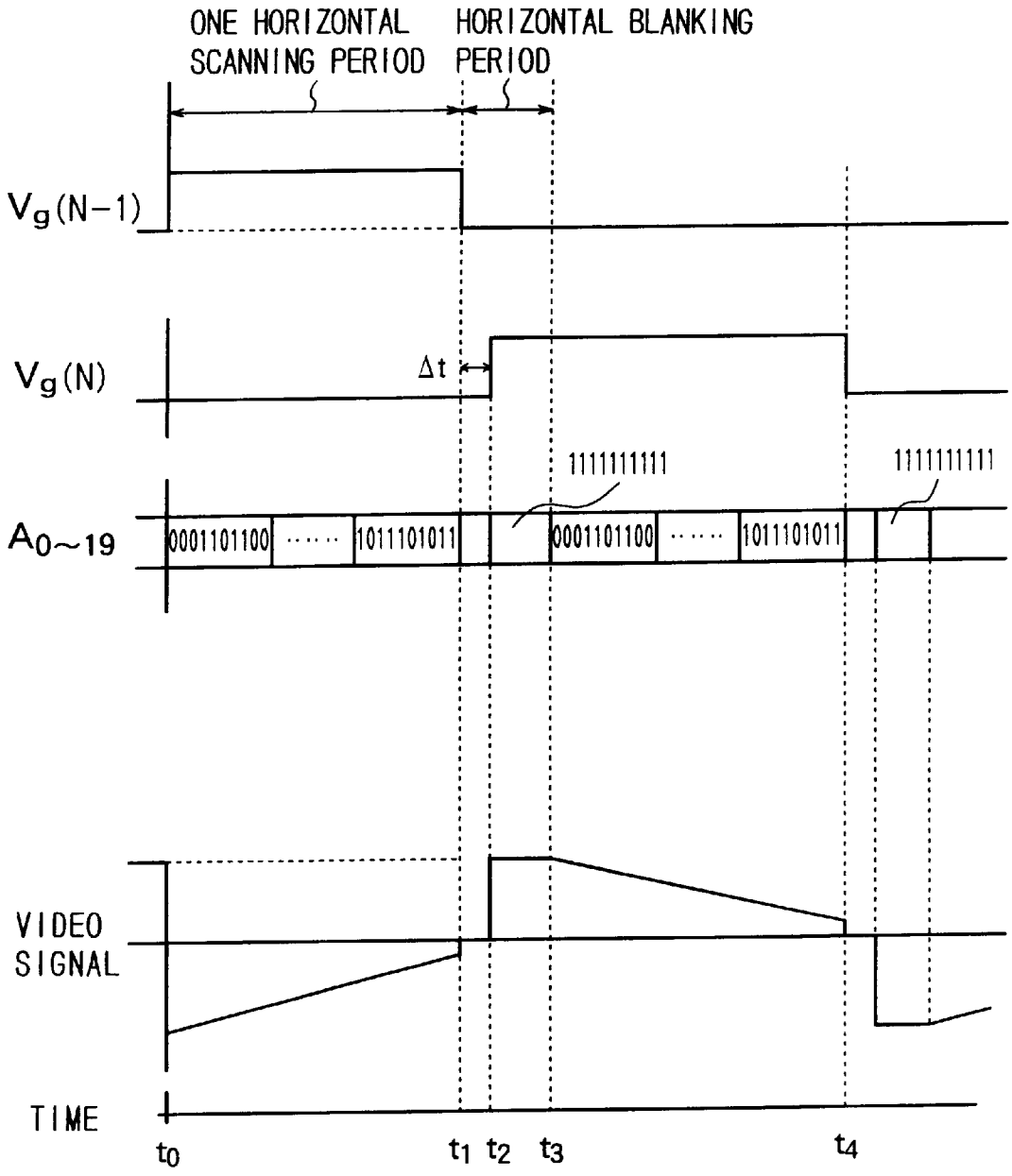
FIG. 13 is a drive timing chart of the fifth embodiment of the display device according to the present invention.

The fifth embodiment of the display device according to the present invention will be described hereinbelow with reference to FIGS. 12 and 13. FIG. 12 shows the construction of the video signal driving circuit 291 of the fifth embodiment, in which a matrix wiring section 801, a logic circuit 802, a buffer amplifier circuit 804, and a video signal selecting circuit 805 are provided. The matrix wiring section 801 is the same in construction as that of the first embodiment shown in FIG. 2, except the reset signal wire is removed. Further, the logic circuit 802 is the same in construction as that of the first embodiment shown in FIG. 2, except the final-stage NAND gate NA6 is removed. Further, the buffer amplifier circuit 804 and the video signal selecting circuit 805 are both the same in construction as with the case (204 and 205) of the first embodiment shown in FIG. 2.

As shown in FIG. 12, when the non-display data are selected and outputted, the digital numerical value signals DA0 to DA19 inputted to the four NAND gates NA1, NA2, NA3 and NA4 are all set to [H]. Further, in synchronism with these signals, the non-display data are supplied to the video signal bus line 806. By doing this, it is possible to write the non-display data to all the video signal lines.

(6th Embodiment)

In the first to fifth embodiments, the non-display areas are formed on both the right and left sides of the display area as shown in FIG. 4. Without being limited only thereto, in the display device according to the present invention, the non-display data can be displayed easily even when the non-display areas are formed on both the upper and lower sides of the display area as shown in FIG. 14, as described hereinbelow.

The sixth embodiment of the display device will be described hereinbelow with reference to FIG. 14 to 16. In this sixth embodiment, in any of the first to fourth embodiments, the scanning line driving circuit 293 as shown in FIG. 5 is used to easily display the display picture as shown in FIG. 14.

Figure 14:
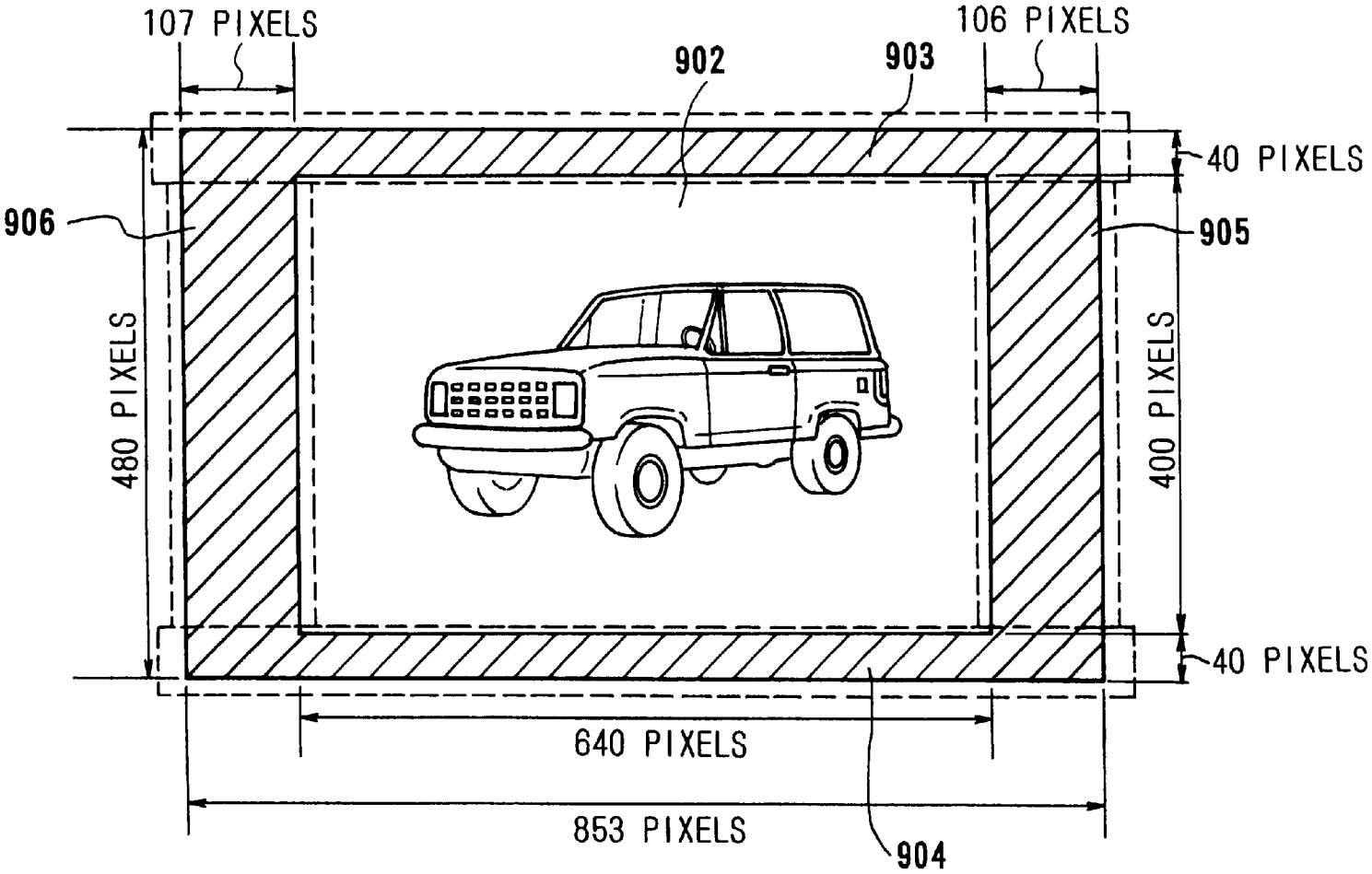
FIG. 14 is an example of pictures displayed by the display device according to the present invention.

In FIG. 14, in the display data display area 902, the scanning line driving circuit 293 outputs the gate-on voltage Vg to the scanning line $Y_1$, the scanning line $Y_2$, . . . , the scanning line $Y_n$ in sequence. In contrast with this, in order to write the non-display data in the upper and lower non-display data display areas 903 and 904, the scanning line driving circuit 293 outputs the gate-on voltage Vg to all the scanning lines of the non-display areas.

Figure 15:
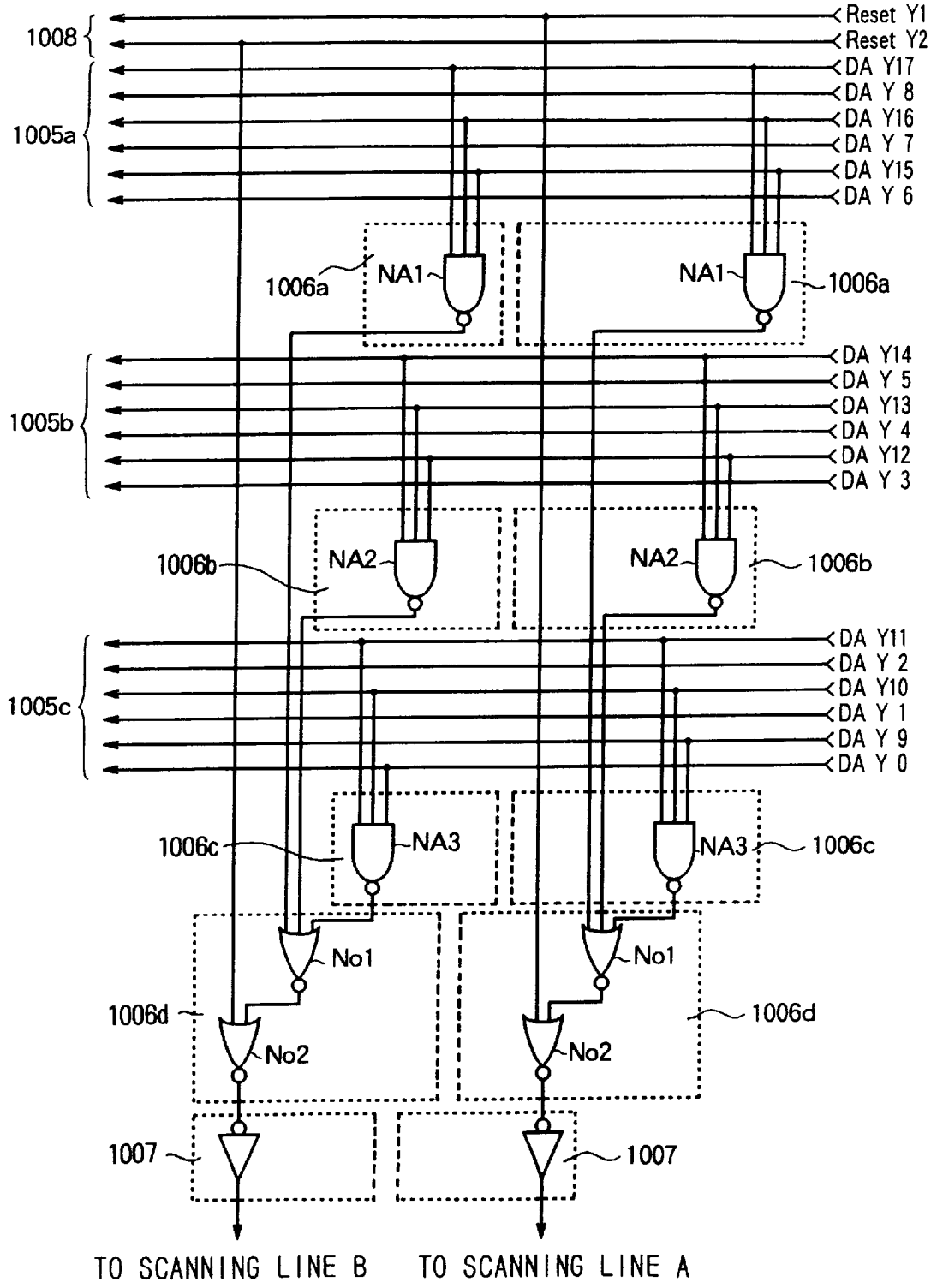
FIG. 15 is a practical circuit diagram showing the scanning line driving circuit of a sixth embodiment of the display device according to the present invention.
Figure 16:
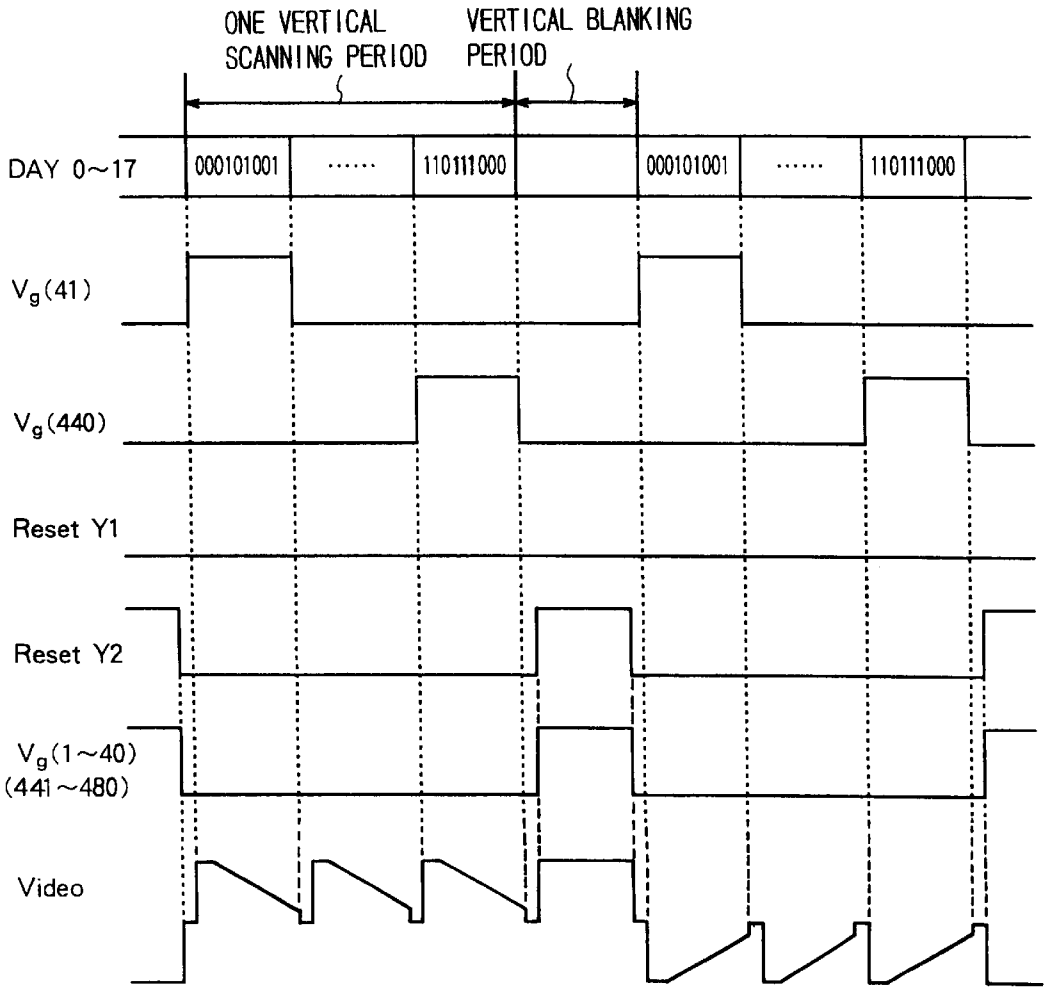
FIG. 16 is a drive timing chart of the sixth embodiment of the display device according to the present invention.

In the scanning line driving circuit 293 of this embodiment comprises three matrix wiring sections 1005*a*, 1005*b* and 1005*c*, a reset signal wiring section 1008, four logic circuits 1006*a*, 1006*b*, 1006*c* and 1006*d* provided for each scanning line, and two buffer amplifier circuit 107, as shown in FIG. 15.

Now, when the address signals for selecting the scanning line $Y_j$ (j=1, . . . , n) are denoted by $A_0$, . . . , $A_8$) ($A_i$ (i=1, . . . , 8) has a value of 0 or 1), the matrix wiring sections 1005*a*, 1005*b* and 1005*c* have 18 wires in total. To these 18 wires, the numerical values DAY0 to DAY8 of the address signals of 9 bits $A_0$, . . . , $A_8$ and the numerical values DAY9 to DAY17 of the inverted 9 bits $A_0$, . . . , $A_8$ are all inputted, respectively.

The matrix wiring section 1005*a* is composed of three wires to which the numerical values DAY6 to DAY8 are inputted, and three wires to which the numerical values DAY15 to DAY17 are inputted. The matrix wiring section 1005*b* is composed of three wires to which the numerical values DAY3 to DAY5 are inputted, and the three wires to which the numerical values DAY12 to DAY14 are inputted. Further, the matrix wiring section 1005*c* is composed of three wires to which the numerical values DAY0 to DAY2 are inputted, and three wires to which the numerical values DAY9 to DAY 11 are inputted.

Further, the reset signal wiring section 1008 is composed of a wire to which the reset signal ResetY1 is inputted and a wire to which the reset signal ResetY2 is inputted.

The three logic circuits 1006*a*, 1006*b* and 1006*c* is each composed of three three-input NAND gates NA1, NA2 and NA3. The logic circuit 1006*d* is composed of two two-input NOR gates NO1 and NO2. Any one of the numerical value signals DAY6 and DAY15, any one of the numerical signals DAY7 and DAY16, and any one of the numerical signals DAY8 and DAY17 are inputted to the NAND gate NA1. Any one of the numerical value signals DAY3 and DAY12, any one of the numerical signals DAY4 and DAY13, and any one of the numerical signals DAY5 and DAY14 are inputted to the NAND gate NA2. Any one of the numerical value signals DAY0 and DAY9, any one of the numerical signals DAY1 and DAY10, and any one of the numerical signals DAY2 and DAY11 are inputted to the NAND gate NA3. Further, the outputs of the three NAND gates NA1, NA2 and NA3 are inputted to the NOR gate NO1. The combinations of the numerical values connected to the three three-input NAND gates NA1, NA2 and NA3 are different from each other for each different scanning line.

The output of the NOR gate NO1 and the reset signal are inputted to the two-input NOR gate NO2, and the logical result thereof is transmitted to the scanning line via the buffer amplifier circuit 1007. Further, a reset signal ResetY1 is inputted from the reset signal wiring section 1008 to the logic circuit 1006*d* for selecting the scanning lines A of the display area, and in the same way a reset signal ResetY2 is inputted from the reset signal wiring section 1008 to the logic circuit 1006*d* for selecting the scanning lines B of the non-display area. When all the inputs of the NAND gates NA1, NA2 and NA3 connected as described above are at [H], or when the reset signal is at [H], the NOR gate NO2 of the logic circuit (decoder) 1006*d* outputs an [L] signal.

When the non-display areas on the upper and lower sides of the display panel are not displayed, since the reset signals ResetY1 and ResetY2 are both kept at [L], the scanning signal driving circuit 293 outputs the scanning voltage in sequence for only the vertical canning period. In contrast with this, when the non-display areas on the upper and lower sides of the display panel are displayed, the reset signal ResetY1 is kept always at [H], but the reset signal RestY2 is at [L] for the vertical scanning period, but at [H] for the vertical blanking period, as shown in FIG. 16. Therefore, in both the logic circuits 1006*d* to which the reset signal ResetY2 is inputted respectively, the sampling pulses are outputted to the buffer amplifier circuits 1007, irrespective of the inputs of the NAND gates NA1, NA2, NA3 and NA4, so that the scanning voltages can be outputted as shown in FIG. 16. In accompany with this, since the video signal line driving circuit 291 outputs the non-display data for the vertical scanning period, so that the non-display data can be written in a plurality of the horizontal pixel lines.

In this embodiment, since the reset signal ResetY1 is always kept at [L], the circuit including no NOR gate NO2 for obtaining the logical result of both the reset signal ResetY1 and the output of the NOR gate NO1 can be used. In this embodiment, however the NOR gates NO2 are provided at all the stages so that a difference in operating speed will not be generated between the stages.

FIG. 14 shows an example of the displayed pictures, in which the non-display data are written on both right and left sides of the display area for the horizontal blanking period and further the non-display data are written on both the upper and lower sides of the display area by use of the above-mentioned driving circuit. In the example shown in FIG. 14, the display device has 853×480 pixels in total, and the computer image signals are displayed in the display area 902 of 640×400 pixels and the non-display data are displayed in the remaining display areas 903, 904, 905 and 906, respectively.

Further, it is of course possible to allow the display device according to the present invention to comply with a plurality of the video signal standards related to many vertical pixels, by setting two or more reset signals.

(7th Embodiment)

In the above-mentioned first to sixth embodiments, although a decoder is used as each logical circuit for the video signal line driving circuit 291 and the scanning line driving circuit 293. Without being limited thereto, a shift registers can be used, instead of the decoder. The case where the shift registers are used for the logic circuits of the video signal line driving circuit will be described hereinbelow.

The seventh embodiment of the display device according to the present invention will be described hereinbelow with reference to FIGS. 17 to 19. In this seventh embodiment, the video signal line driving circuit 291 of the liquid crystal display device shown in FIG. 1 is replaced with the video signal line driving circuit as shown in FIG. 17.

Figure 17:
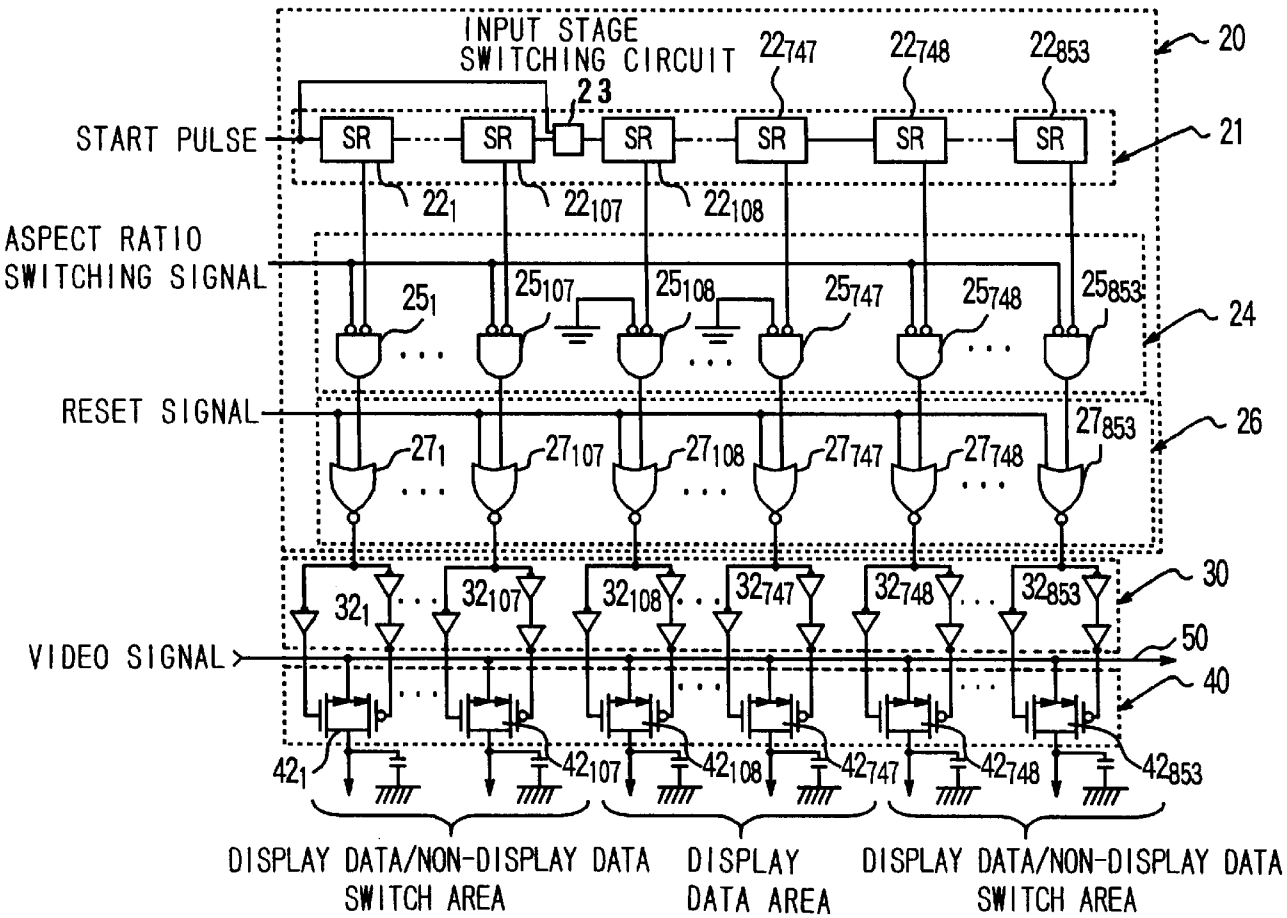
FIG. 17 is a practical circuit diagram showing the video signal line driving circuit of the seventh embodiment of the display device according to the present invention.

The video signal line driving circuit shown in FIG. 17 comprises a logic circuit 20, a buffer amplifier section 30, and a video signal selecting circuit 40. The logic circuit 20 is composed of a horizontal shift register circuit 21, an aspect ratio switching circuit 24 and a reset circuit 26, and generates a timing signal for fetching the video data or the non-display data form the video signal bus line 50 on the basis of a start pulse, an aspect ratio switching signal, and the reset signal, in sequence.

Now, when the number of horizontal pixels and the number of vertical pixels in the display area of the display device according to this embodiment are 853×480 as shown in FIG. 4; that is, when the aspect ratio is 16:9, the shift register circuit 21 is composed of 853-units of D type flip-flops $\mathbf{22}_1, \ldots, \mathbf{22}_{853}$ corresponding to the number of the horizontal pixels and an input stage switching circuit 23. Here, the 853-units of D type flip-flops $\mathbf{22}_1, \ldots, \mathbf{22}_{853}$ are connected in cascade.

Further, in the display area, the input stage switching circuit 23 is connected between the flip-flop $\mathbf{22}_{108}$ corresponding to the horizontal pixel from which the display area 502 starts as shown in FIG. 4 and the flip-flop $\mathbf{22}_{107}$ at the front stage of this flip-flop $\mathbf{22}_{108}$. When a start pulse is inputted to the flip-flop $\mathbf{22}_1$ from the outside, the start pulse is transferred to the succeeding stage flop-flop $\mathbf{22}_2$ in synchronism with a clock pulse (not shown), and at the same time the output (i.e., timing signal) of the shift register circuit 21 is transmitted to the aspect ratio switching circuit 24. The above-mentioned operation is repeated by each flip-flop at each stage in sequence. The output of the flip-flop $\mathbf{22}_{107}$ is transmitted to the input stage switching circuit 23.

When the display picture having an aspect ratio of 16:9 is displayed, the input stage switching circuit 23 selects the output of the flip-flop $\mathbf{22}_{107}$. However, when the display picture having an aspect ratio of 4:3 is displayed, the input stage switching circuit 23 selects the bypassed start pulse and transmits the selected start pulse to the succeeding stage flip-flop $\mathbf{22}_{108}$. The flip-flop $\mathbf{22}_{108}$ transfers the output (i.e., start pulse) of the input stage switching circuit 23 to the succeeding stage flip-flop $\mathbf{22}_{109}$ and the aspect ratio switching circuit 24, in synchronism with the clock pulse. The above-mentioned operation is repeated by each flip-flop at each stage, so that the start pulse is transferred to the succeeding stage flip-flop and the aspect ratio switching circuit 24, respectively.

The aspect ratio switching circuit 24 is composed of 853-units of NOR circuits $\mathbf{25}_1, \ldots, \mathbf{25}_{853}$. The NOR circuit $\mathbf{25}_i$ (i=1, . . . , 107; 748, . . . , 853) executes the NOR operation on the basis of the aspect ratio switching signal and the output of the flip-flop $\mathbf{22}_i$, and transmits the operation result to the reset circuit 26. The NOR circuit $\mathbf{25}_i$ (i=108, . . . , 747) executes the NOR operation on the basis of the aspect ratio switching signal and an [L] level signal, and transmits the operation result to the reset circuit 26. The reset circuit 26 is composed of 853-units of NOR circuits $\mathbf{27}_1, \ldots, \mathbf{27}_{853}$. The NOR circuit $\mathbf{27}_i$ (i=1, . . . , 853) executes the NOR operation on the basis of the output of the NOR circuit $\mathbf{25}_i$ of the aspect ratio switching circuit 24 and the reset signal, and transmits the operation result to the buffer amplifier section 30.

The buffer amplifier section 30 is composed of 853-units of buffer amplifier circuits $\mathbf{32}_1, \ldots, \mathbf{32}_{853}$. The video signal line selecting circuit 40 is composed of 853-units of transfer gates $\mathbf{42}_1, \ldots, \mathbf{42}_{853}$. The buffer amplifier circuit $\mathbf{32}_i$ (i=1, . . . , 853) amplifies and inverts the output of the NOR circuit $\mathbf{27}_i$, and inputs the amplified and inverted signal to the gates of the p-channel and n-channel TFTs for constituting a transfer gate $\mathbf{42}_i$, respectively.

During the period when the transfer gate $\mathbf{42}_i$ (i=1, . . . 853) is turned on, the video data or the non-display data transmitted through the video signal bus line are sampled, and then transmitted to the corresponding video signal line $X_i$ (i=1, . . . , 853).

Figure 18:
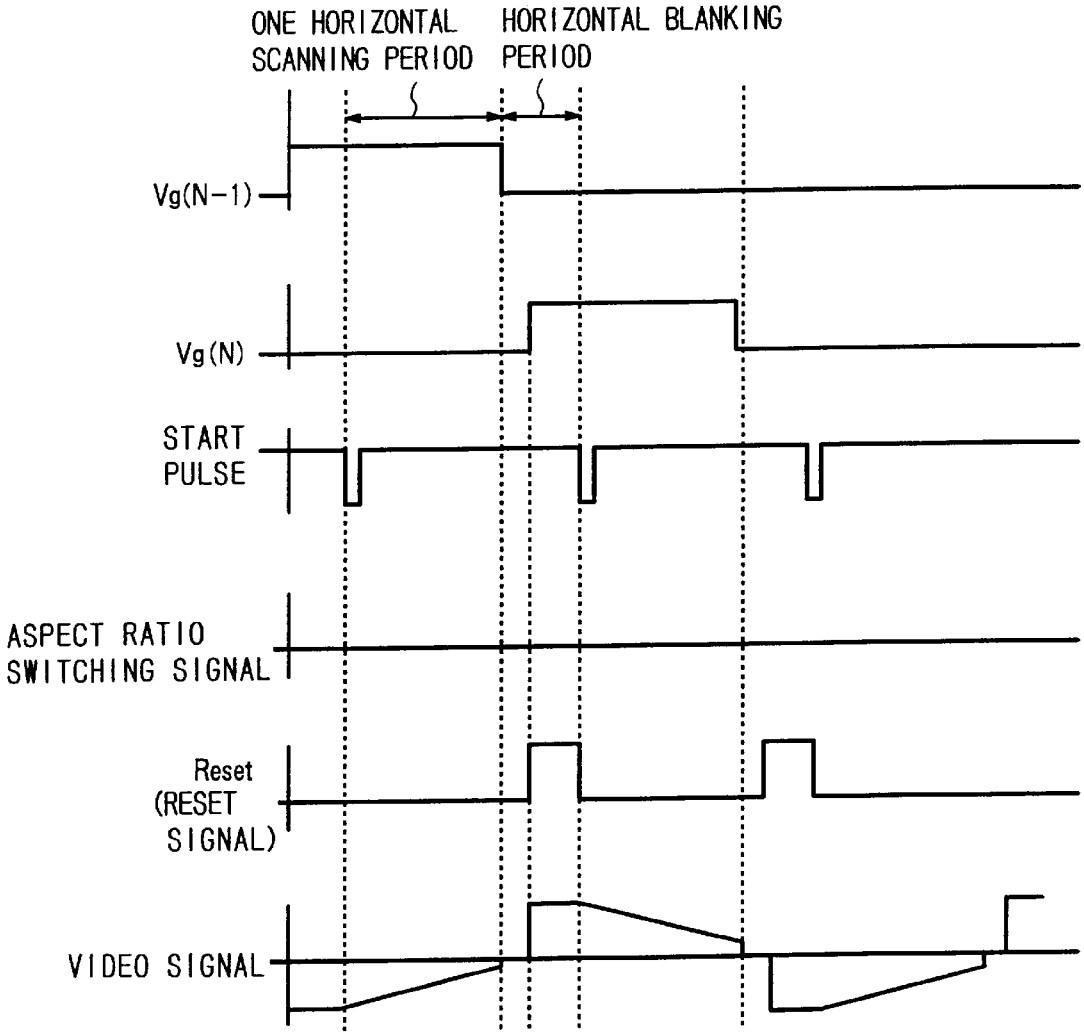
FIG. 18 is a timing char for assistance in explaining a driving method of the seventh embodiment of the display device according to the present invention.
Figure 19:
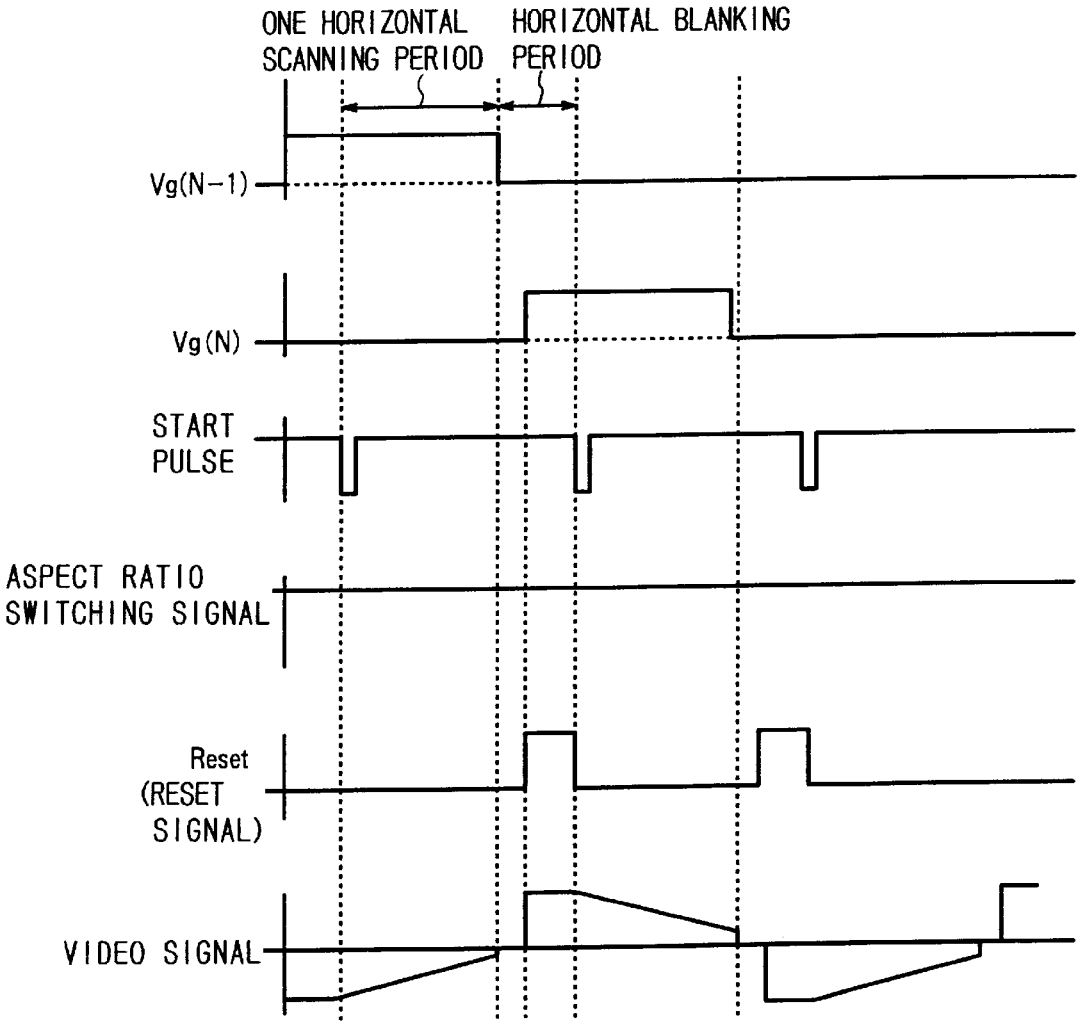
FIG. 19 is a timing chart for assistance in explaining another driving method of the seventh embodiment of the display device according to the present invention.

The operation of this seventh embodiment will be described hereinbelow with reference to FIGS. 18 and 19, in which FIG. 18 is a timing chart for a display picture having an aspect ratio of 16:9, and FIG. 19 is a timing chart for a display picture having an aspect ratio of 4:3.

When the display picture having an aspect ratio of 16:9 is displayed, the aspect ratio switching signal is set to [L] level. Further, the output of the flip-flop $\mathbf{22}_{107}$ is selected and then transmitted to the flip-flop $\mathbf{22}_{108}$, by the input stage switching circuit 23. Therefore, the start pulse inputted to the horizontal shift register circuit 21 from the outside at the start of one horizontal scanning period is transferred to the flip-flops $\mathbf{22}_1, \ldots, \mathbf{22}_{853}$ in sequence in synchronism with the clock signal, and further the timing signal is transmitted from each flip-flop $\mathbf{22}_i$ (i=1, . . . , 853) to the corresponding NOR circuit $\mathbf{25}_i$ of the aspect ratio switching circuit 24. Further, in this embodiment, the start pulse and the timing signal are both set to a negative logic, respectively; on the other hand, the reset signal is set to a positive logic, as shown in FIG. 18. When the timing signal is transmitted from each flip-flop $\mathbf{22}_i$ (i=1, . . . , 583) to the corresponding NOR circuit $\mathbf{25}_i$, an [H] level signal is outputted from the NOR circuit $\mathbf{25}_i$, and then transmitted to the corresponding NOR circuit $\mathbf{27}_i$ of the reset circuit 26.

During one horizontal scanning period, since the reset signal is set to [L] level, only when the output of the NOR circuit $\mathbf{25}_i$ is at [H], [L] level signal is outputted from the NOR circuit $\mathbf{27}_i$ (i=1, . . . , 853), so that the corresponding transfer gate $\mathbf{42}_i$ is turned on via the buffer amplifier circuit $\mathbf{32}_i$. Therefore, the video data are fetched from the video signal bus line 50 by the transfer gate $\mathbf{42}_i$ (i=1, . . . , 853), as shown in FIG. 18. As described above, during one horizontal scanning period, the video data are given to the video signal lines $X_i$ to $X_{853}$, in sequence.

Further, in this embodiment, since the reset signal is set to [H] at a time within the horizontal blanking period as shown in FIG. 18, the [L] level signal can be outputted from each NOR circuit $\mathbf{27}_i$ (i=1, . . . , 853) of the reset circuit 26, so that all the transfer gates $\mathbf{42}_i, \ldots, \mathbf{42}_{853}$ are turned on. At this time, when the non-display data (e.g., black display potential) are supplied to the video signal bus line 50, the non-display data are transmitted to the corresponding video signal line $X_i$ via the transfer gate $\mathbf{42}_i$ (i=1, . . . , 853). Therefore, in the same way as with the case of the first embodiment, the non-display data are written in the 853-units of the pixel electrodes via the TFTs 121 connected to the scanning line now selected by the scanning line driving circuit 293.

When the display picture having an aspect ratio of 4:3 is displayed, as shown in FIG. 19, the aspect ratio switching signal is fixed to [H] level. Therefore, the outputs of the NOR circuits $\mathbf{25}_1$ to $\mathbf{25}_{107}$ and the NOR circuits $\mathbf{25}_{748}$ to $\mathbf{25}_{853}$ of the aspect ratio switching circuit 24 are always kept at [L] level. However, since the reset signal is set to [H] level at a time within the horizontal blanking period as shown in FIG. 19, in the same way as with the case of the aspect ratio of 16:9, the non-display data are written in the 853-units of the pixel electrodes via the TFTs 121 connected to the scanning line now selected by the scanning line driving circuit 293.

Further, during the one horizontal scanning period, since the outputs of the NOR circuits $\mathbf{25}_1$ to $\mathbf{25}_{107}$ and the NOR circuits $\mathbf{25}_{748}$ to $\mathbf{25}_{853}$ of the aspect ratio switching circuit 24 are always kept at [L] level as described above, and further since the reset signal is at [L] level as shown in FIG. 19, the outputs of the NOR circuits $\mathbf{27}_1$ to $\mathbf{27}_{107}$ and the NOR circuits $\mathbf{27}_{748}$ to $\mathbf{27}_{853}$ of the reset circuit 26 are all at [H] level. Therefore, during one horizontal scanning period, the transfer gates $\mathbf{42}_1$ to $\mathbf{42}_{107}$ and the transfer gates $\mathbf{42}_{748}$ to $\mathbf{42}_{853}$ are not turned on, so that the video data are not written in the pixel electrodes connected to the corresponding video signal lines $X_1$ to $X_{107}$ and the video signal lines $X_{748}$ to $X_{853}$ via the TFTs 121. Further, the above-mentioned pixel electrodes hold the data written during the horizontal blanking period.

Further, the start pulse transmitted from the outside during the one horizontal scanning period is inputted to the flip-flops $22_1$, and further inputted to the flip-flop $22_{108}$ via the input stage switching circuit 23. Further, in synchronism with the clock signal, the start pulse is transmitted from the flip-flop $22_1$ to the flip-flop $22_{107}$ in sequence. Further, the start pulse is transmitted from the flip-flop $22_{108}$ to the final stage flip-flop $22_{853}$ in sequence. Further, the output of the flip-flop $22_{107}$ is not transmitted to the flip-flop $22_{108}$ by the input stage switching circuit 23.

Further, in synchronism with the clock signal, the start pulse is outputted from each flip-flop $22_i$ (i=1, . . . , 853) of each stage, and further the timing signal is transmitted to each corresponding NOR circuit $25_i$.

As described above, although the timing signal is transmitted to each NOR circuit $25_i$ (i=1, . . . , 853) during one horizontal scanning period, as already explained, the transfer gates $42_1$ to $42_{107}$ and the transfer gates $42_{748}$ to $42_{853}$ are not turned on.

In contrast with this, since the transfer gates $42_{108}$ to $42_{747}$ are turned on in response to the timing signal in the same way as with the case of the aspect ratio of 16:9, the video data can be selected. Therefore, the video data are written in the pixel electrodes connected to the video signal lines $X_i$ (i=108, . . . , 747) via the TFTs 121, so that the video data are displayed on the display area 502, but the non-displayed data are displayed on both the non-display areas 503 and 504, as shown in FIG. 4.

Further, in the seventh embodiment, the shift registers are used as the logic circuits of the video signal line driving circuit 291 of the first embodiment, instead of the decoders. Without being limited only to the first embodiment, in the second, fourth and fifth embodiments, it is of course possible to use the shift registers as the logic circuits of the video signal line driving circuit, instead of the decoders.

Further, in this embodiment, since a common analog switch is used as the switch for selecting the video data and the non-display data, the size of the video signal line driving circuit can be reduced, so that a region (referred to as a picture frame) around the display picture where the video signal line driving circuit is arranged can be reduced. In addition, since the video signal line driving circuit can be arranged on both sides of the display area, and thereby the video signal lines can be driven from both sides, it is possible to obtain a further higher definition picture.

(8th Embodiment)

Figure 20:
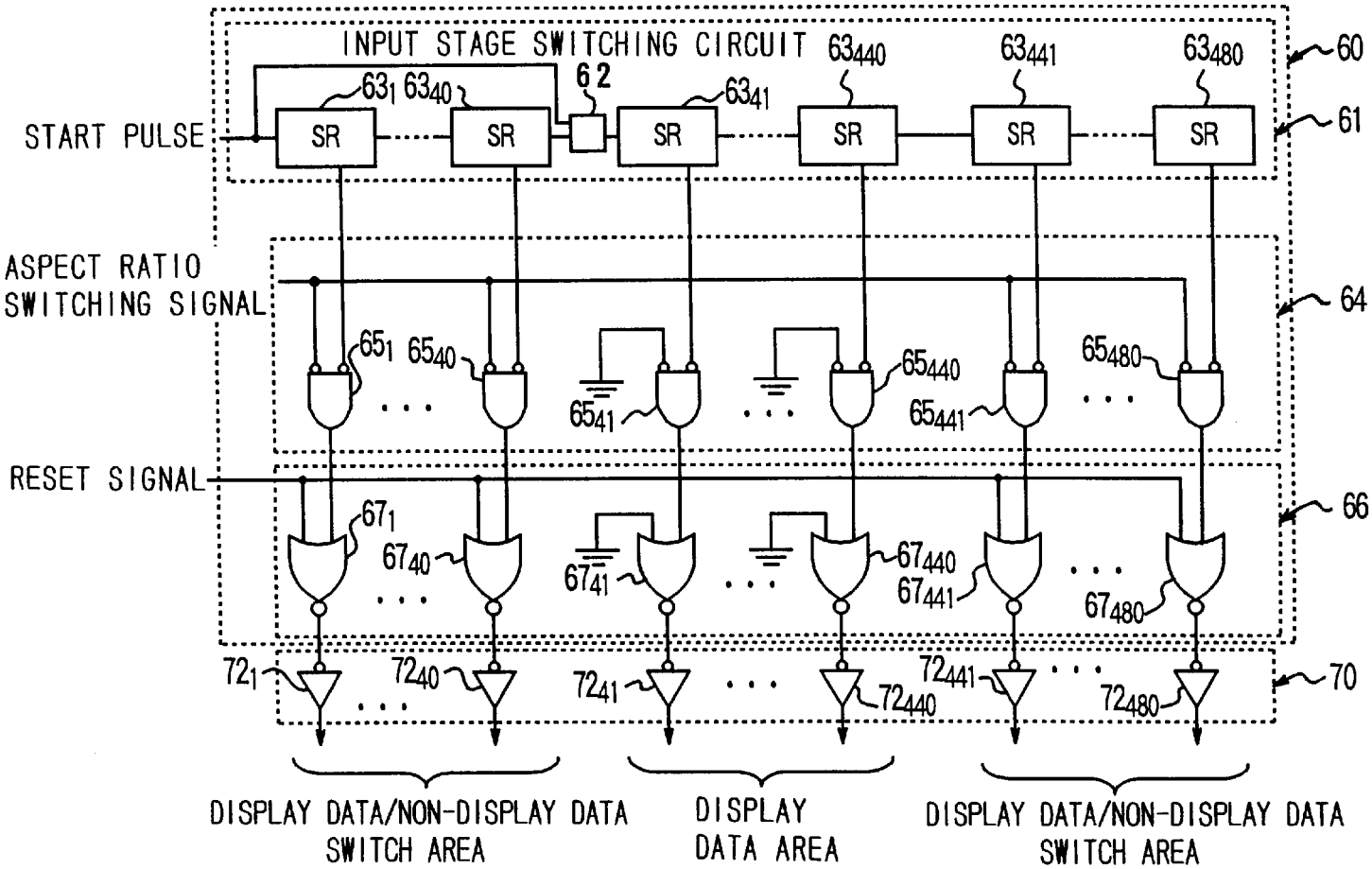
FIG. 20 is a practical circuit diagram showing the scanning line driving circuit of an eighth embodiment of the display device according to the present invention.

An eighth embodiment will be described hereinbelow with reference to FIGS. 20 to 22, in which the shift registers are used as the logic circuits of the scanning line driving circuit 293 shown in FIG. 1. In other words, the eighth embodiment of the display device is different from the seventh embodiment in that the shift registers are used as the logic circuits of the scanning line drive circuit 293, in addition to the video signal line driving circuit 291. Further, the scanning line driving circuit 293 is composed of a logic circuit 60 and a buffer amplifier circuit 70.

The logic circuit 60 is composed of a shift register circuit 61, an aspect ratio switching circuit 64 and a reset circuit 66, and generates a timing signal for selecting the scanning line on the basis of a start pulse, an aspect ratio switching signal, and the reset signal, in sequence.

Now, when the number of horizontal pixels and the number of vertical pixels of the display area 281 (shown in FIG. 1) of the display device according to this embodiment are 853×480 as shown in FIG. 14; that is, the aspect ratio is 16:9, the shift register circuit 61 is composed of 480-units of D type flip-flops $63_1$, . . . , $63_{480}$ corresponding to the number of the vertical pixels and an input stage switching circuit 62. Here, the 480-units of D type flip-flops $63_1$, . . . , $63_{480}$ are connected in cascade.

Further, when a display picture 902 having an aspect ratio of 8:5 as shown in FIG. 14 is displayed in the display area 281, an input stage switching circuit 62 is connected between the flip-flop $63_{41}$ corresponding to the vertical pixel from which the display area 902 starts and the flip-flop $63_{40}$ at the front stage of this flip-flop $63_{41}$.

Therefore, when a start pulse is inputted to the flip-flop $63_1$ from the outside, the start pulse is transferred to the succeeding stage flop-flop in synchronism with a clock pulse (not shown), and simultaneously the timing signals are transmitted from the flip-flop $63_i$ (i=1, . . . , 40) to the aspect ratio switching circuit 64, in sequence.

When the display picture 902 having an aspect ratio of 8:5 is displayed in the display area 281 (shown in FIG. 1), the input stage switching circuit 62 selects the bypassed start pulse. However, when the display picture 502 having an aspect ratio of 4:3 as shown in FIG. 4 is displayed, the input stage switching circuit 62 selects the output of the flip-flop $63_{40}$ and then transmits the selected output to the succeeding stage flip-flop $63_{41}$.

The flip-flop $63_{41}$ transfers the output of the input stage switching circuit 62 to the succeeding stage flip-flop $63_{42}$ (not shown) and further to the aspect ratio switching circuit 64, in synchronism with the clock pulse. The above-mentioned operation is repeated by the flip-flop at each stage, so that the start pulse is transferred in sequence to the succeeding stage flip-flop and the aspect ratio switching circuit 44, respectively.

The aspect ratio switching circuit 64 is composed of 480-units of NOR circuits $65_1$, . . . , $65_{480}$. The NOR circuit $65_i$ (i=1, . . . , 40; 411, . . . , 480) executes the NOR operation on the basis of the aspect ratio switching signal and the output of the flip-flop $63_i$, and transmits the operation result to the reset circuit 66. The NOR circuit $65_i$ (i=41, . . . , 440) executes the NOR operation on the basis of the output of the flip-flop $63_i$ and the [L] level signal, and transmits the operation result to the reset circuit 66. The reset circuit 66 is composed of 480-units of NOR circuits $67_1$, . . . , $67_{480}$. The NOR circuit $67_i$ (i=1, . . . , 40; 411, . . . , 480) executes the NOR operation on the basis of the output of the NOR circuit $65_i$ of the aspect ratio switching circuit 64 and the reset signal, and transmits the operation result to the buffer amplifier section 70. Further, The NOR circuit $67_i$ (i=41, . . . , 440) executes the NOR operation on the basis of the output of the NOR circuit $65_i$ and the [L] level signal, and transmits the operation result to the buffer amplifier section 70.

The buffer amplifier section 70 is composed of 480-units of buffer amplifier circuits $72_1$, . . . , $72_{480}$. The buffer amplifier circuit $72_i$ (i=1 , . . . , 480) amplifies an inversion output of the NOR circuit $67_i$ of the reset circuit 66, and transmits the amplified inversion output to the corresponding scanning line $Y_i$.

Figure 21:
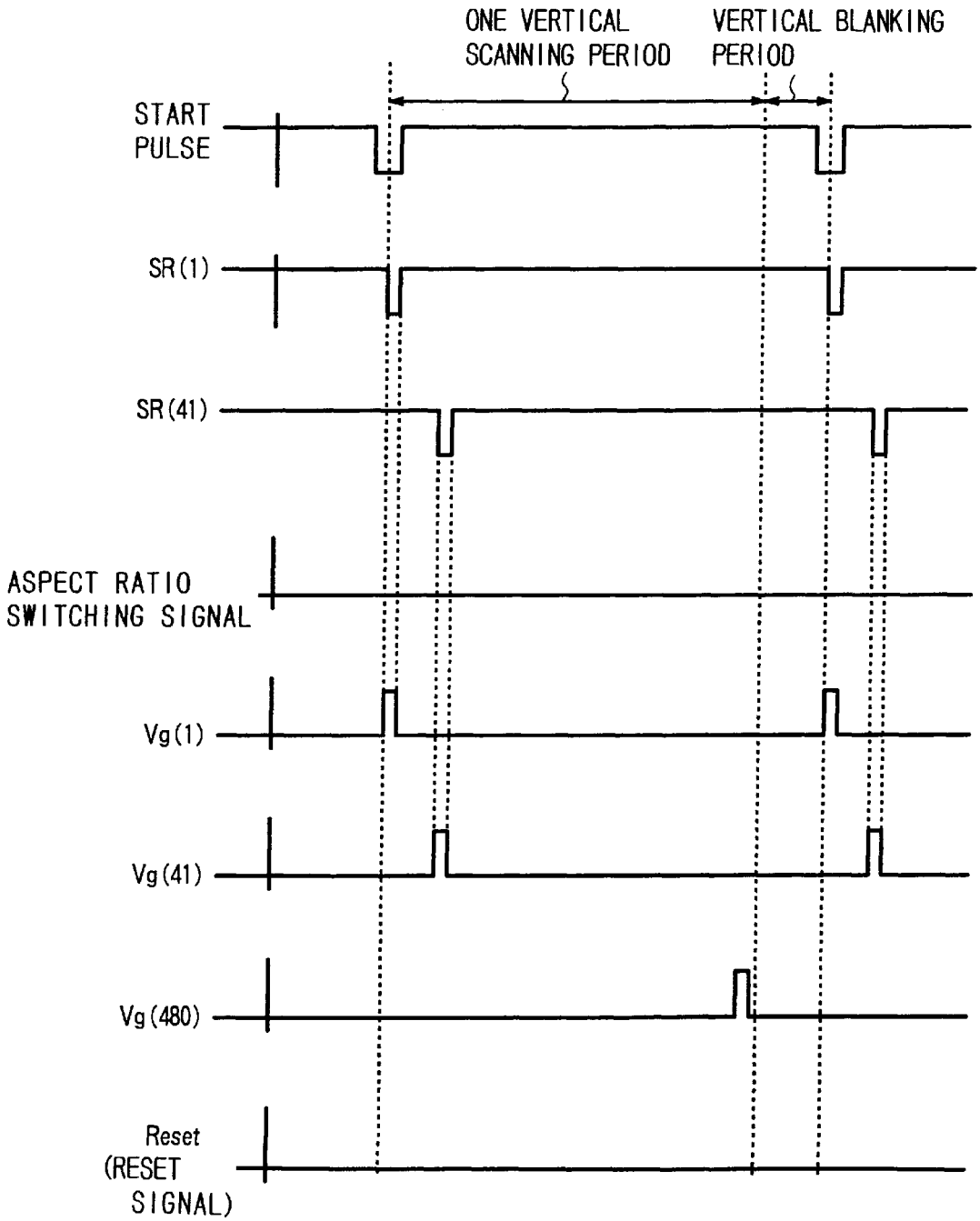
FIG. 21 is a timing chart for assistance in explaining a driving method of the eighth embodiment of the display device according to the present invention.
Figure 22:
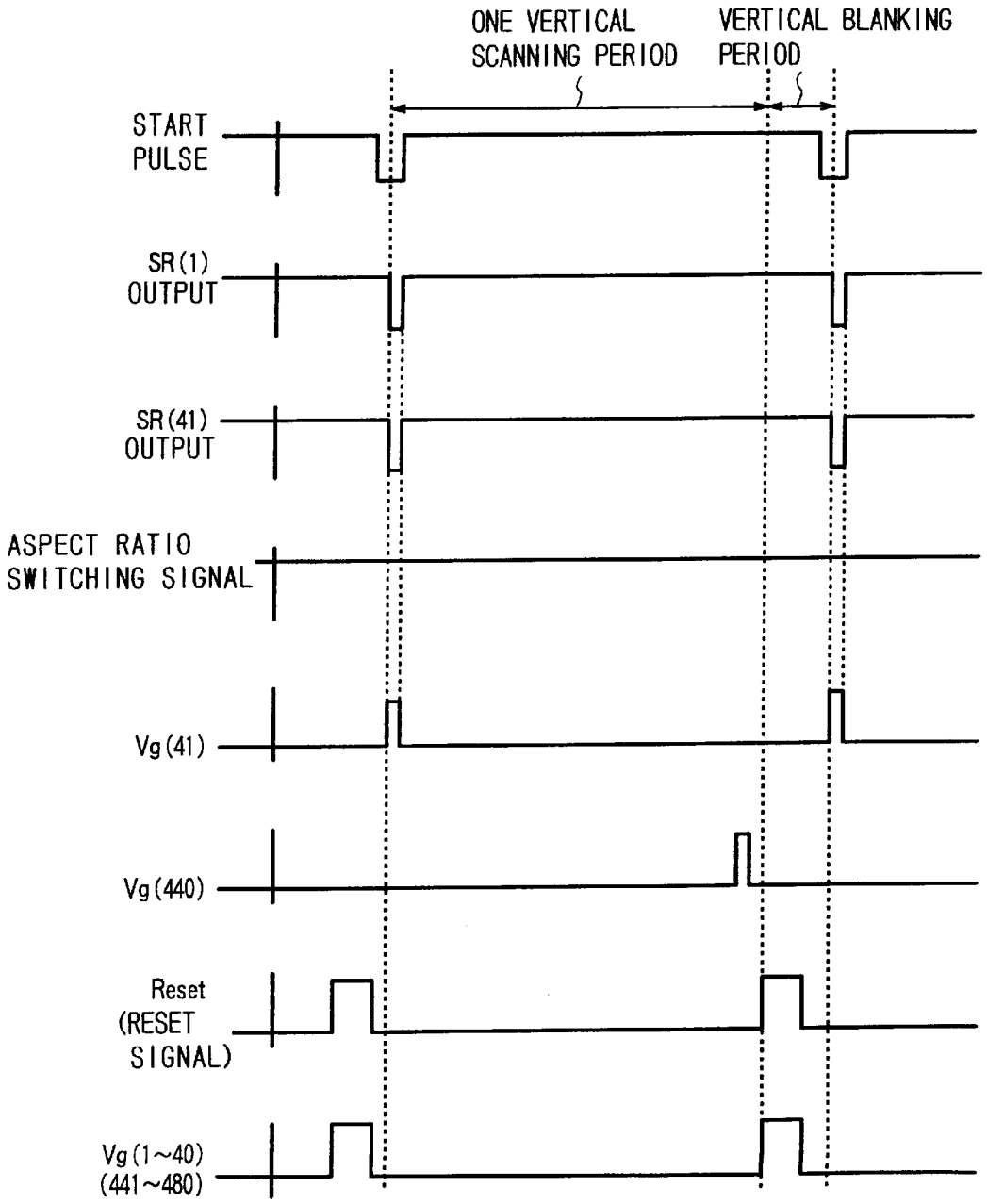
FIG. 22 is a timing chart for assistance in explaining anther driving method of the eighth embodiment of the display device according to the present invention.

The operation of this eighth embodiment will be described hereinbelow with reference to FIGS. 21 and 22, in which FIG. 21 is a timing chart for a display picture having an aspect ratio of 4:3, and FIG. 22 is a timing chart for a display picture having an aspect ratio of 8:5.

When the display picture having an aspect ratio of 4:3 is displayed, the aspect ratio switching signal and the reset signal (a positive logic in this embodiment) are both set to [L] level. Further, the output of the flip-flop $63_{40}$ is selected and then transmitted to the flip-flop $63_{41}$, by the input stage switching circuit 62.

Therefore, the start pulse inputted to the shift register circuit 61 from the outside at the start of one vertical scanning period is transferred to the flip-flops $\mathbf{63}_1, \ldots, \mathbf{63}_{480}$ in sequence in synchronism with the clock signal, and further the [L]-level timing signal SR(i) is transmitted from each flip-flop $\mathbf{63}_i$ (i=1, . . . , 480) to the corresponding NOR circuit $\mathbf{65}_i$ of the aspect ratio switching circuit 64, as shown in FIG. 21. Then, the [H]-level pulse signal is outputted by the NOR circuit $\mathbf{65}_i$ (i=1, . . . , 480), so that the [L]-level pulse signal is outputted by the NOR circuit $\mathbf{67}_i$ of the reset circuit 66 and further the [H]-level pulse signal Vg(i) is outputted by the corresponding buffer amplifier circuit $\mathbf{72}_i$.

As described above, data can be written in sequence in all the scanning lines during one vertical scanning period, so that the display picture having an aspect ratio of 4:3 as shown in FIG. 4 can be displayed.

When the display picture with an aspect ratio of 8:5 is displayed, the aspect ratio switching signal is set to [H] level as shown in FIG. 22, and the reset signal is set to [H] level only during the vertical blanking period. Further, the bypassed start pulse is selected and then transmitted to the flip-flop $\mathbf{63}_{41}$, by the input stage switching circuit 62.

Therefore, the start pulse inputted to the shift register circuit 61 from the outside at the start of one vertical scanning period is transferred to the flip-flops $\mathbf{63}_1, \ldots, \mathbf{63}_{41}$ and the flip-flops $\mathbf{63}_{41}, \ldots, \mathbf{63}_{480}$ in sequence in synchronism with the clock signal, and further the [L]-level timing signal SR(i) is transmitted from each flip-flop $\mathbf{63}_i$ (i=1, . . . , 480) to the corresponding NOR circuit $\mathbf{65}_i$ of the aspect ratio switching circuit 64, as shown in FIG. 22.

Then, the [H]-level pulse signal is outputted by the NOR circuit $\mathbf{65}_i$ (i=1, . . . , 480). However, since the aspect ratio switching signal is set to [H] level, the output of the other NOR circuit $\mathbf{65}_i$ (i=1, . . . , 40; 441, . . . , 480) is kept fixed at [L] level.

Therefore, although the output of the NOR circuit $\mathbf{67}_i$ (i=1, . . . , 40; 441, . . . , 480) is kept fixed at [H] level during one vertical scanning period, the NOR circuit $\mathbf{67}_i$ (i=41, . . . , 441) of the display data area outputs [L]-level pulse signal, only when the pulse signal is received from the corresponding NOR circuit $\mathbf{65}_i$ of the aspect ratio switching circuit 64.

Therefore, the output of the buffer amplifier circuit $\mathbf{72}_i$ (i=1, . . . , 40; 441, . . . , 480) of the display switch areas 903 and 904 (as shown in FIG. 14) is fixed at [L] level during one vertical scanning period, so that the scanning lines are not selected in the display switch areas. However, since the selecting timing signal Vg(i) is outputted in sequence from the buffer amplifier circuit $\mathbf{72}_i$ (i=41, . . . , 440) of the data display area, the corresponding scanning line $Y_i$ is scanned in sequence during one vertical scanning period. Therefore, the video data can be written only in the display data display area 902.

Further, since the reset signal is set to [H] level at a predetermined period within one vertical blanking period, the output of the NOR circuit $\mathbf{67}_i$ (i=1, . . . , 40; 441, . . . , 480) of the display switch areas 903 and 904 is set to [L] level during a predetermined period during the vertical blanking period. Further, in this case, the output of the NOR circuit $\mathbf{67}_i$ (i=41, . . . , 441) in the display area is at [H] level.

Accordingly, since the outputs of the buffer amplifier circuits in the display switch areas are set to [H] level, the scanning line $Y_i$ (i=1, . . . , 40; 441, . . . , 480) of the display switch areas is always being selected during the above-mentioned period, so that all the TFTs connected to the scanning line are turned on. Further, since the outputs of the buffer amplifier circuits in the display area are set to [L] level, all the TFTs connected to the scanning line $Y_i$ (i=41, . . . , 440) of the display area are all turned off during the above-mentioned period. In accompany with this, since the video signal line driving circuit 291 outputs the non-display data for the vertical scanning period, so that the non-display data can be written in a plurality of the horizontal pixel lines.

As described above, in the eighth embodiment, it is possible to display the non-display data in the non-display areas easily.

Figure 23:
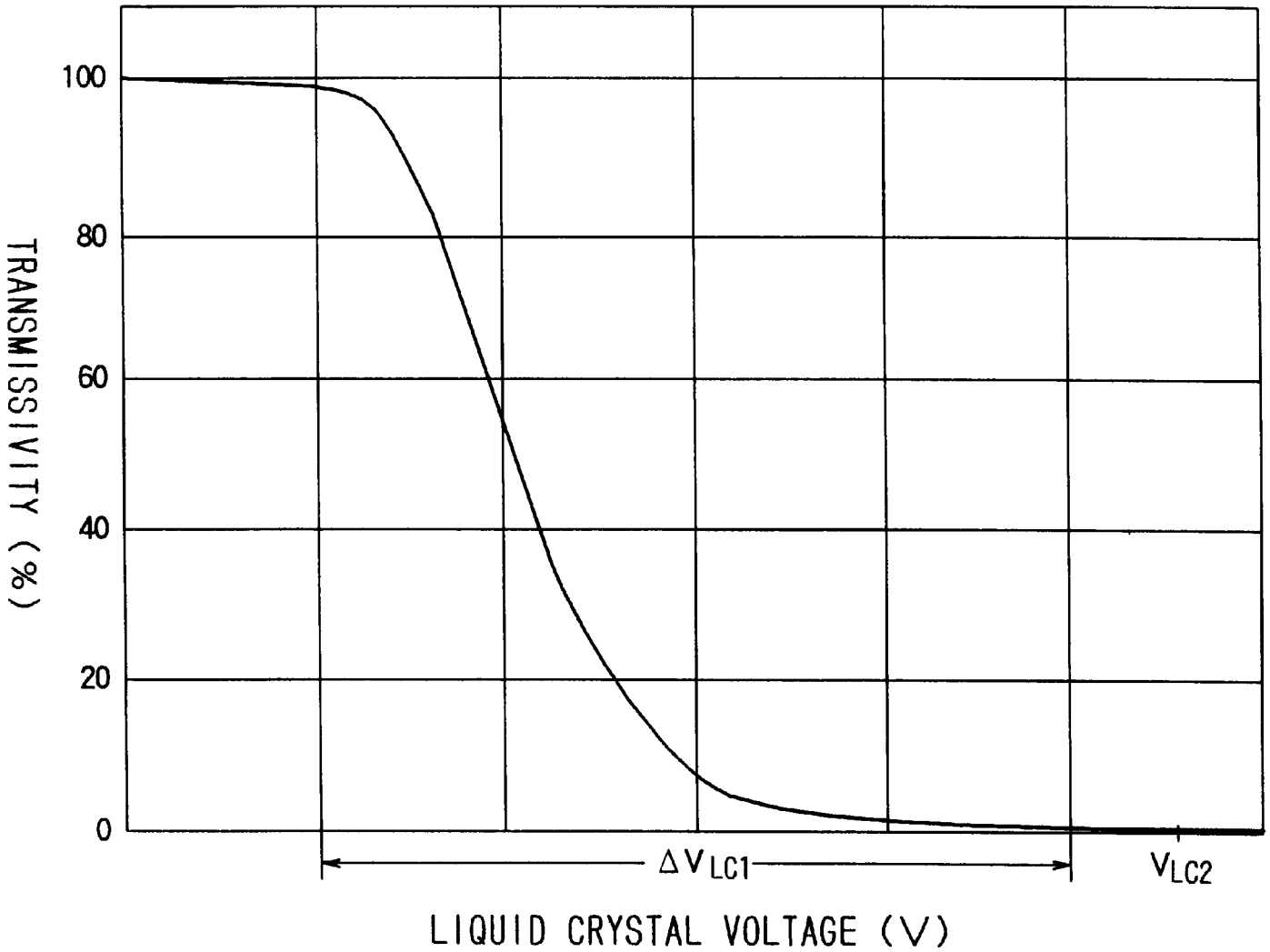
FIG. 23 is a graphical representation showing the relationship between the liquid crystal application voltage and the light transmissivity.

Further, in the above-mentioned first to eighth embodiments, as shown in FIG. 23, it is possible to suppress the flicker by setting the voltage applied to the liquid crystal when the non-display data are written to a voltage $V_{Lc2}$ higher than the voltage range $\Delta V_{Lc1}$ applied to the liquid crystal when the display data are displayed.

Further, in the above-mentioned embodiments, although the non-display data are determined as black display, the non-display data can be determined as white or any intermediate gradation.

Further, in the above-mentioned embodiments, although the display device is the liquid crystal display device, the present invention can be of course applied to other display devices easily.

As described above, in the display device according to the present invention, it is possible to display the non-display data easily in the non-display areas, respectively.

What is claimed is:

1. A display device, comprising:

a display panel section including:

a plurality of pixel electrodes arranged in a matrix pattern;

a plurality of switching elements each arranged in correspondence to each pixel electrode;

a plurality of scanning lines each connected in common to said switching elements corresponding to said pixel electrodes arranged in a same row direction, for transmitting a control signal for opening and closing said common-connected switching elements simultaneously;

a plurality of video signal lines for transmitting video signals to said pixel electrodes arranged in a same column direction via said corresponding switching elements, respectively; and an opposing electrode arranged so as to be opposed to said pixel electrodes; and a video signal line driving circuit for generating a first timing signal according to a single reset signal received before video data transmitted via a video signal bus line are received; for selecting non-display data transmitted in synchronism with the single reset signal on the basis of the first timing signal; for transmitting the selected non-display data to all of said video signal lines simultaneously; after that, for selecting the transmitted video data on the basis of a second timing signal; and for transmitting the selected video data to said video signal line corresponding to the second timing signal, wherein said single reset signal does not include address information of non-display areas.

2. The display device of claim 1, wherein said video signal line driving circuit comprises:

a plurality of logic circuits, each for outputting the first or second timing signal on the basis of n-bit address signals and the reset signal; and a plurality of selecting circuits, each for selecting the video data or the non-display data on the basis of an output of said logic circuit.

3. The display device of claim 1, wherein said video signal line driving circuit comprises:

a plurality of logic circuits, each for outputting the first or second timing signal on the basis of n-bit address signals;

a plurality of first selecting circuits, each for selecting the non-display data on the basis of the first timing signal; and a plurality of second selecting circuits, each for selecting the video data on the basis of the second timing signal.

4. The display device of claim 1, wherein said video signal line driving circuit comprises:

a logic circuit including:

a shift register circuit composed of a plurality of cascade-connected flip-flops and responsive to a start pulse, for transferring the start pulse to the succeeding-stage flip-flop in sequence in synchronism with a clock signal; and a reset circuit for outputting the first timing signals and the second timing signals on the basis of an output of each-stage flip-flop of said shift register circuit and the reset signal; and a selecting circuit for selecting the video data or the non-display data on the basis of the first timing signals and the second timing signals.

5. The display device of claim 4, which further comprises switching means connected between a predetermined-stage flip-flop and the succeeding-stage flip-flop of said shift register circuit; for switching a first circuit connection for selecting an output of the predetermined-stage flip-flop to a second circuit connection for selecting a pulse signal obtained by bypassing the start pulse inputted to the first-stage flip-flop or vice versa, according to an aspect ratio of a display picture; and for transmitting the selected signal to the succeeding-stage flip-flop.

6. The display device of claim 5, wherein said logic circuit further comprises means for, when said switching means switches the first circuit connection to the second connection for selecting the bypassed pulse signal, inhibiting the second timing signals from being outputted on the basis of the outputs of a plurality of said flip-flops including the first to predetermined stage flip-flops.

7. The display device of claim 1, wherein said display panel section comprises:

an array substrate formed with said pixel electrodes, said switching elements, said scanning lines, and said video signal lines;

an opposing substrate formed with said opposing electrodes; and a liquid crystal layer sandwiched between said array substrate and said opposing substrate.

8. The display device of claim 7, wherein said video signal line driving circuit is formed on said array substrate.

9. A display device, comprising:

a display panel section including:

a plurality of pixel electrodes arranged in a matrix pattern;

a plurality of switching elements each arranged in correspondence to each pixel electrode;

a plurality of scanning lines each connected in common to said switching elements corresponding to said pixel electrodes arranged in a same row direction, for transmitting a control signal for opening and closing said common-connected switching elements simultaneously;

a plurality of video signal lines for transmitting video signals to said pixel electrodes arranged in same column direction via said corresponding switching elements, respectively; and an opposing electrode arranged so as to be opposed to said pixel electrodes; and a scanning line driving circuit including:

a plurality of logic circuits, each for selecting a scanning line during a first period, when a single reset signal is not received; and for selecting another scanning line during a second period different from the first period when the single reset signal is received; and a plurality of buffer amplifier circuits, each for supplying the control signal to the selected scanning line on the basis of an output of said logic circuit, wherein said single reset signal does not include address information of non-display areas.

10. The display device of claim 9, wherein said logic circuit selects the scanning line on the basis of an m-bit address signal and the reset signal.

11. The display device of claim 9, wherein said logic circuits comprise:

a shift register circuit composed of a plurality of cascade-connected flip-flops and responsive to a start pulse, for transferring the start pulse to the succeeding-stage flip-flop in sequence in synchronism with a clock signal; and a reset circuit for outputting a signal for selecting the scanning line on the basis of an output of each-stage flip-flop of said shift register circuit and the reset signal.

12. The display device of claim 11, which further comprises switching means connected between a predetermined-stage flip-flop and the succeeding-stage flip-flop of said shift register circuit; for switching a first circuit connection for selecting an output of the predetermined-stage flip-flop to a second circuit connection for selecting a pulse signal obtained by bypassing the start pulse inputted to the first-stage flip-flop or vice versa, according to an aspect ratio of a display picture; and for transmitting the selected signals to the succeeding-stage flip-flop.

13. The display device of claim 12, wherein said logic circuit further comprises means for, when said switching means switches the first circuit connection to the second circuit connection for selecting the bypassed pulse signal, inhibiting the signals for selecting the scanning lines from being outputted on the basis of the outputs of a plurality of said flip-flops including the first stage to predetermined stage flip-flops.

14. The display device of claim 9, wherein said display panel section comprises:

an array substrate formed with said pixel electrodes, said switching elements, said scanning lines, and said video signal lines;

an opposing substrate formed with said opposing electrodes; and a liquid crystal layer sandwiched between said array substrate and said opposing substrate.

15. The display device of claim 14, wherein said video signal line driving circuit is formed on said array substrate.

16. A driving method for the display device of claim 1, wherein the non-display data are written during one horizontal blanking period, and the video data are written during one horizontal scanning period.

17. The driving method for the display device of claim 16, wherein polarity of signals of the non-display data written during one horizontal blanking period is the same as that of signals of the video data written during one horizontal scanning period.

18. The driving method for the display device of claim 16, wherein when the non-display data are displayed, a potential difference between the pixel electrode and the opposing electrode different from that used for the video data display is used.

19. A method of driving a display device including a display panel and a scanning line driving circuit for forming a display picture based upon video data on the display panel, the display panel includes a plurality of pixel electrodes arranged in a matrix pattern; a plurality of switching elements each arranged in correspondence to each pixel electrode; a plurality of scanning lines each connected in common to said switching elements corresponding to said pixel electrodes arranged in a same row direction for transmitting a control signal for opening and closing said common-connected switching elements simultaneously; a plurality of video signal lines for transmitting video signals to said pixel electrodes arranged in a same column direction via said corresponding switching elements, respectively; and an opposing electrode arranged so as to be opposed to said pixel electrodes, and the scanning line driving circuit includes a plurality of logic circuits, each for selecting a scanning line during a first period, when a single reset signal is not received; and for selecting another scanning line during a second period different from the first period when the single reset signal is received; and a plurality of buffer amplifier circuits, each for supplying the control signal to the selected scanning line on the basis of an output of said logic circuit, said single reset signal not including address information of non-display areas, the method comprising the steps of:

when the number of horizontal pixel lines each composed of a plurality of display pixels during one vertical scanning period including one vertical blanking period of the video data is smaller than a total number of the horizontal lines on the display panel;

writing non-display data in a plurality of horizontal pixel lines not corresponding to the video date simultaneously for a first period; and writing the video data in at least one horizontal pixel line corresponding to the video data for a second period different from the first period.

20. The method of driving a display device of claim 19, wherein the first period is one vertical blanking period, and the second period is one vertical scanning period.

* * * * *